US005140961A

United States Patent [19]

Sawamoto et al.

[11] Patent Number: 5,140,961

[45] Date of Patent: Aug. 25, 1992

[54] SYSTEM AND METHOD FOR SELF DIAGNOSING AN ENGINE CONTROL SYSTEM

[75] Inventors: Kunifumi Sawamoto; Kenji Ikeura; Masaaki Saito, all of Kanagawa; Nobuo Kurihara, Ibaraki, all of Japan

[73] Assignees: Nissan Motor Co., Ltd.; Hitachi Ltd., both of Japan

[21] Appl. No.: 639,873

[22] Filed: Jan. 11, 1991

[30] Foreign Application Priority Data

Jan. 12, 1990 [JP] Japan ..... 2-5374
Jan. 12, 1990 [JP] Japan ..... 2-5375
Jan. 12, 1990 [JP] Japan ..... 2-5376

[51] Int. Cl.[5] ..... F02P 5/06
[52] U.S. Cl. ..... 123/419; 123/417
[58] Field of Search ..... 123/419, 417, 425, 436

[56] References Cited

U.S. PATENT DOCUMENTS 4,596,217 6/1986 Bonitz et al. ..... 123/425
4,841,933 6/1989 McHale et al. ..... 123/419
4,928,652 5/1990 Shinya et al. ..... 123/417
4,993,389 2/1991 Ahlborn et al. ..... 123/436
5,016,591 5/1991 Nanyoshi et al. ..... 123/419

*Primary Examiner*—Raymond A. Nelli

*Attorney, Agent, or Firm*—Leydig, Voit & Mayer

[57] ABSTRACT

A system and method for self diagnosing an engine controlling system such as an ignition system, fuel injection system, and an EGR (Exhaust Gas Recirculation) system are disclosed in which a periodic pseudo random signal is superposed on a control signal such as an ignition signal, fuel injection signal, or EGR rate controlled value indicating signal during an engine steady state condition, a cross-correlation function is calculated from both the superposed periodic random signal and output signal related to deterioration of the engine controlling system, and a value related to the cross-correlation function is compared with a reference value over which a performance of the engine controlling system cannot be maintained. If the value related to the cross-correlation function exceeds the reference value, the diagnostic system determines the occurrence of deterioration in the engine controlling system. The output related to the deteroration of the engine controlling system is, for example, a number of occurrences of misfiring determined according to change in engine revolutional speed. The periodic pseudo random signal is, for example, an M-series sequence signal. In the case of a diagnostic system for an EGR system the value related to the cross-correlation function may be, for example, a step response.

35 Claims, 24 Drawing Sheets

SYSTEM AND METHOD FOR SELF DIAGNOSING AN ENGINE CONTROL SYSTEM

BACKGROUND OF THE INVENTION

1. Field of the Invention

The present invention relates to a system and method for self diagnosing a magnitude of deterioration of an engine controlling system, such as an ignition system, a fuel injection system, and/or EGR (Exhaust Gas Recirculation) control system applicable to an automotive IC (Internal Combustion) engine using a cross-correlation function derived from functions of a periodic pseudo random signal and an output signal related to deterioration of the engine controlling system.

2. Description of the Background Art

An ignition system has been put into practice which carries out ignition of an air-fuel mixture supplied to each cylinder of the engine.

The ignition systems generally include a vehicular battery, an ignition coil, a plurality of ignition plugs, each installed so as to be exposed to a corresponding combustion chamber, and a power transistor which turns on and off a primary current of the ignition coil. When the primary current flowing through the primary winding of the ignition coil is interrupted at a time when a cylinder piston reaches a predetermined angular position before top dead center (BTDC) in each compression stroke, a high surge voltage is generated across a secondary winding of the ignition coil, the high surge voltage being supplied to one of the ignition plugs of the corresponding cylinder in the compression stroke. At this time, the ignition plug is sparked to ignite the air-fuel mixture supplied into the corresponding combustion chamber.

It is noted that, for a six-cylinder engine, an ignition signal (pulse signal) supplied to a base of the power transistor has its falling edge at a timing of which is the ignition timing and a time duration during which the power transistor is in the ON state is defined as a, so-called, dwell angle, i.e., a duration of time during which the power transistor continues to turn on (primary current is flowing through the primary winding).

A control unit of the ignition system controls both ignition timing and dwell angle according to an instantaneous engine driving condition. The control unit is constituted by a microcomputer.

Deterioration of the ignition system tends to accelerate depending on its use environment and, in a worst case, cannot maintain its perdetermined performance although it has durability such that it may continue to function past its useful period of time. For example, if the ignition coil is deteriorated, it becomes impossible to provide a sufficient discharge energy across each ignition plug. Consequently, misfiring tends to occur in the combustion chambers.

To cope with such a situation as described above, it is important to monitor the performance of the ignition system during the driving of the engine before a failure such as breakage in the ignition system occurs and to take appropriate measures when deterioration of the ignition system has been determined.

However, since the ignition system is usually not provided with a function for monitoring its operation, a vehicule driver may continue to operate the vehicle without knowing of the deteriorated ignition system.

It is noted that, although one previously proposed ignition system has detection means for detecting a primary voltage across the ignition coil and determining means for determining that a misfire has occurred when the value of the primary voltage is below a predetermined value, this may be caused by such as breakage, and an input circuit for detecting the primary voltage required. However, this previously proposed system cannot determine if any one ignition plug or plugs have failed even though the ignition coil is normal.

Further, fuel injection systems have been put into practice in order to carry out accurate fuel control under a wide engine operating condition to reduce exhaust gas emission.

A fuel injection system generally includes a fuel tank, a fuel supply pump, a pressure regulator, and a fuel injector installed so as to be exposed toward an intake port of the engine. The pressure regulator serves to maintain a fuel pressure supplied to the fuel injector constant.

The fuel injector has a valve portion which opens only during a flow of current into its solenoid during the opening of which fuel is injected and supplied to the intake port. A quantity of fuel injected from the fuel injector is determined during which the current flows through the solenoid.

The problem described in the case of the ignition system can be applied equally well to a previously proposed fuel injection system.

Furthermore, EGR (Exhaust Gas Recirculation) systems have also been widely put into practice.

An EGR system is installed in the engine in order to return a part of exhaust gas to an intake air system in order to reduce a harmful component of exhaust gas (NOx).

Previously proposed EGR systems include a passage communicated between an exhaust manifold and intake manifold for bypassing the engine, an EGR control valve intervened in the bypass passage, and a negative pressure control electromagnetic valve to produce a controlled negative pressure toward the EGR control valve.

The EGR control valve increases and decreases in opening angle according to the controlled negative pressure introduced into a working chamber of the control valve so that a recirculated quantity (EGR quantity) of the exhaust gas flowing through the bypass passage is controlled.

The negative pressure control electromagnetic valve includes a constant pressure valve portion for providing an intake manifold negative pressure for a constant negative pressure of −120 mmHg and a solenoid valve portion for providing a controlled negative pressure from −15 through −120 mmHg when introducing an atmospheric pressure.

A control signal supplied to the solenoid valve portion is an on-and-off pulse, the control unit determining a pulse duty ratio of the On-and-off pulse (EGR ratio controlled value) according to a driving condition of the engine.

The problem described in the case of the ignition system can be applied equally well to the EGR system.

SUMMARY OF THE INVENTION

It is therefore an object of the present invention to provide a system and method for self diagnosing deterioration of an engine controlling system such as an ignition system, fuel injection system, and/or EGR system which can reliably diagnose deterioration of the engine controlling system during the engine driving without disturbing normal operation of the engine.

The above-described object can be achieved by providing a system for self diagnosing an engine controlling system, comprising: a) first means for detecting an engine operating condition; b) second means for calculating a controlled value on the basis of the engine driving condition; c) third means for outputting a signal representing the controlled value; d) fourth means for generating a periodic pseudo random signal; e) fifth means for superposing the periodic pseudo random signal on the signal representing the controlled value f) sixth means for providing an output related to deterioration of the engine controlling system which is minutely changed due to the superposition of the pseudo random signal; g) seventh means for calculating a cross-correlation function on the basis of the output related to deterioration of the engine controlling system and the periodic pseudo random signal h) eighth means for determining whether a value related to the cross-correlation function exceeds a predetermined value; and i) ninth means for providing an output signal when the eighth means determines that the value related to the cross-correlation function exceeds the predetermined value.

The above-described object can also be achieved by providing a method for self diagnosing an engine controlling system, comprising the steps of: a) detecting an engine operating condition; b) calculating a controlled value on the basis of the engine driving condition; c) outputting a signal representing the controlled value; d) generating a periodic pseudo random signal; e) superposing the periodic pseudo random signal on the signal representing the controlled value; f) providing an output related to deterioration of the engine controlling system which is minutely changed due to the superposition of the pseudo random signal; g) calculating a cross-correlation function on the basis of the output related to deterioration of the engine controlling system and the superposed periodic pseudo random signal; h) determining whether a value related to the cross-correlation function exceeds a predetermined value; and i) providing an output signal when the ninth means determines that the value related to the cross-correlation function exceeds the predetermined value.

BRIEF DESCRIPTION OF THE DRAWINGS

FIG. 2 (B) is a schematic circuit drawing of the ignition system to which the first preferred embodiment shown in FIG. 1 is applicable.

DETAILED DESCRIPTION OF THE PREFERRED EMBODIMENTS

Reference will hereinafter be made to the drawings in order to facilitate a better understanding of the present invention.

First and Second Preferred Embodiments

Figure 1:
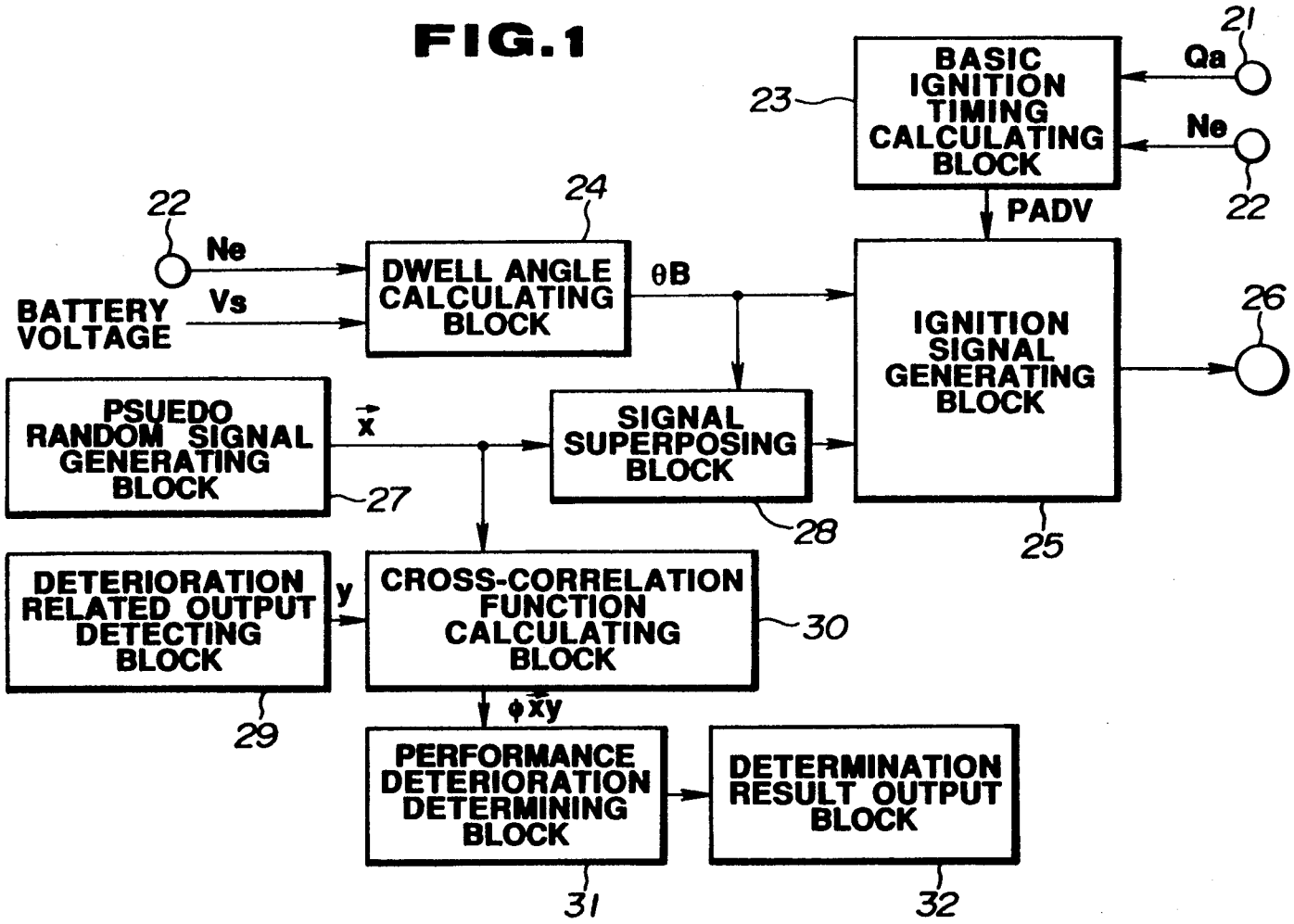
FIG. 1 is a functional circuit block diagram of a system for self diagnosing an engine controlling system applicable to an ignition system of a vehicular internal combustion engine in a first preferred embodiment according to the present invention.

FIG. 1 shows a functional circuit block diagram of a diagnostic system applicable to an ignition system of a vehicular internal combustion engine in a first preferred embodiment according to the present invention.

In FIG. 1, an engine load (for example, an engine intake air quantity Qa) and an engine revolutional speed Ne are detected by means of two sensors 21, 22, respectively. A basic ignition timing calculating block 23 calculates a basic ignition timing advance angle PADV on the basis of the detected engine load Qa and engine revolutional speed Ne. A dwell angle calculating block 24 calculates a dwell angle $\phi B$ which is defined as a duration of time during which an ignition power transistor is held on between an ignition timing for one of the engine cylinders and that for the next engine cylinder on the basis of detected values of the engine revolutional speed and the battery voltage Vs. An ignition signal generating block 25 generates an ignition signal according to the dwell angle $\phi B$ and the basic ignition timing angle value PADV.

An ignition device 26 carries out the ignition to the air-fuel mixture supplied to each cylinder upon receipt of the ignition signal.

In addition, a periodic pseudo random signal (in this embodiment, M-series sequence signal $\vec{x}$) generating block 27 generates a periodic minute pseudo random signal. Then, a superposing block 28 superposes the M-series sequence signal onto a signal representing the dwell angle. A detecting block 29 detects an output signal (for example, the number of occurrences of misfires y) related to a deterioration of the whole ignition system.

Furthermore, a cross-correlation function calculating block 30 calculates a cross-correlation function $\phi\vec{x}y$ from both pseudo random signal $\vec{x}$ and the output signal y.

A determining block 31 determines an occurrence of deterioration in the ignition system depending on if the value of the cross-correlation function $\phi\vec{x}y$ exceeds a reference value Rs. An output block 32 outputs a result of the determination of the determining block 31.

It is noted that, in a second preferred embodiment, the reference value Rs is variably set according to engine load.

As described above, a cross-correlation function calculated from the pseudo random signal which minutely changes the dwell angle $\theta_B$ and the number of occurrences of misfires y is used to grasp a magnitude of deterioration of the ignition system.

In this case, as the deterioration of the ignition system is advanced, the number of occurrences of misfiring is increased. The relationship between a change in the dwell angle and the number of occurrences of misfiring becomes close, thereby the cross-correlation function being increased. As the deterioration is increased to a degree such that a limit over which the performance of ignition system cannot be maintained is exceeded, the value of the cross-correlation function $\phi\vec{x}y$ exceeds the reference value Rs. Hence, if $\phi\vec{x}y > Rs$, the diagnostic system can determine that the ignition system has deteriorated.

A warning lamp, for example, may be installed to be turned on upon determination of deterioration to indicate the ignition system should be repaired. If repairs are affected at this time the ignition system can be returned to a normal state before the ignition system reaches a point of deterioration such that it can no longer ignite the air-fuel mixture supplied to the engine.

In the second preferred embodiment, the reference value Rs is variably set according to the engine load. Therefore, a more accurate determination of deterioration can be made.

Figure 2A:
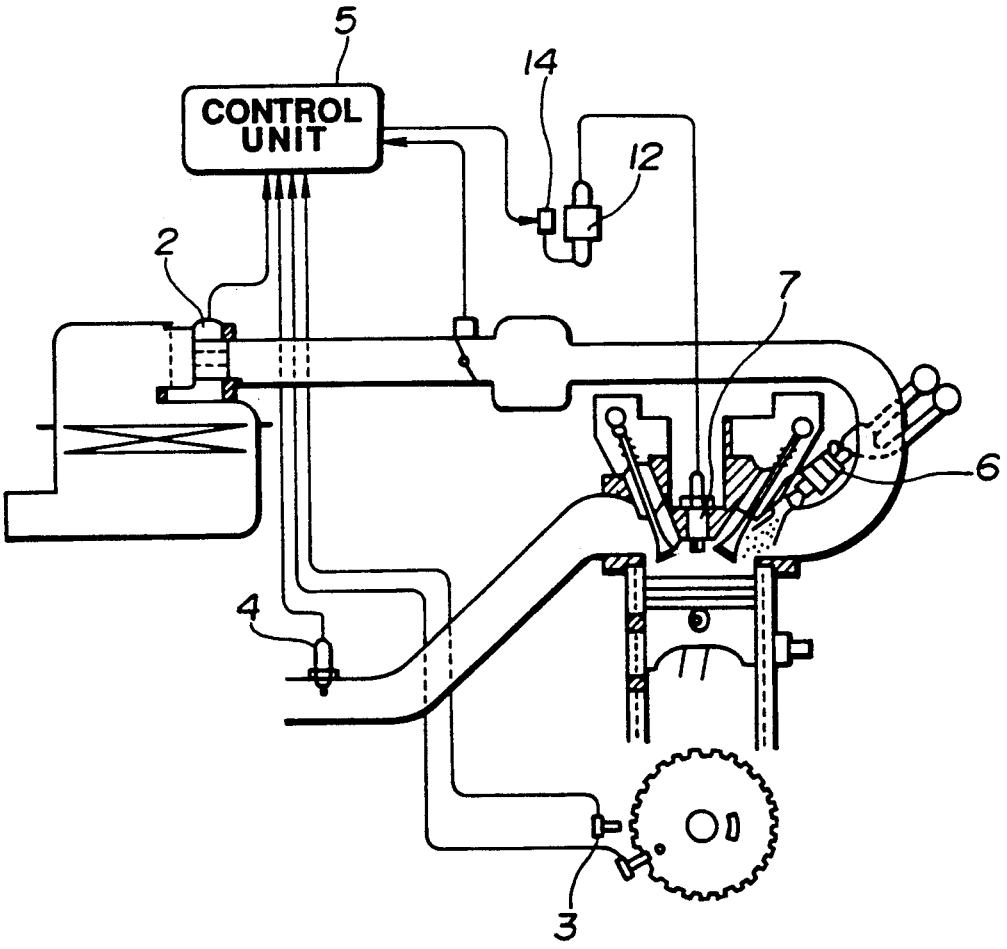
FIG. 2 (A) is a schematic drawing of an engine and control unit to which the first preferred embodiment shown in FIG. 1 is applicable.
Figure 2B:
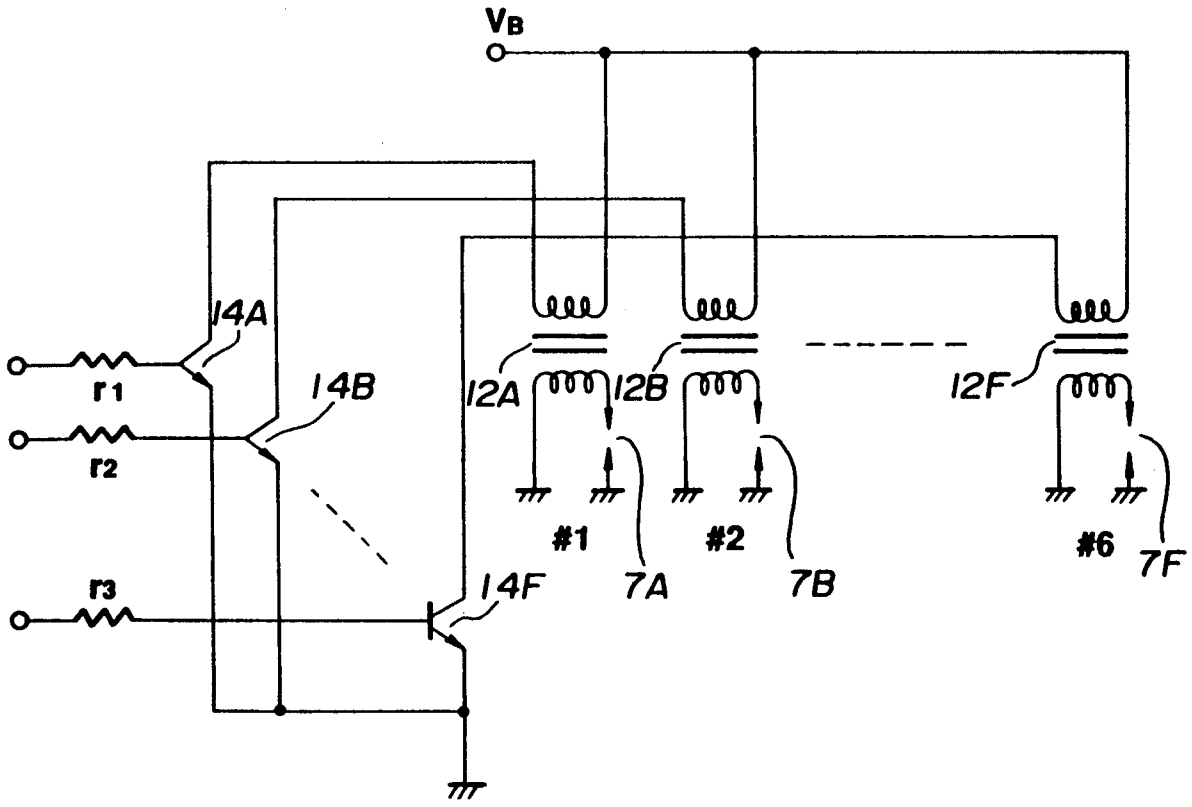

FIG. 2 (A) shows a system configuration of the diagnostic system applicable to the ignition system of the engine.

A control unit denoted by 5 receives input signals of the intake air quantity Qa from an airflow meter 2, of the engine revolutional speed Ne from an engine crank angle sensor 3, and air-fuel mixture ratio sensor (oxygen concentration sensor) 4.

FIG. 2 (B) shows an electronic ignition surge voltage distribution device for a six-cylinder engine.

As shown in FIG. 2 (B), the distribution device includes a plurality of ignition coils 12 A through 12 F, the number of which corresponds to that of the cylinders and a plurality of power transistors 14 A through 14 F. In FIGS. 2 (B), only parts of the cylinders are shown.

Referring to FIG. 2 (A), the control unit 5 supplies to the ignition signal to each power transistor 14 A through 14 F. The control unit 5 then executes the ignition timing control and dwell angle control in accordance with flowcharts of FIG. 5 (A) and 5 (B).

Figure 3:
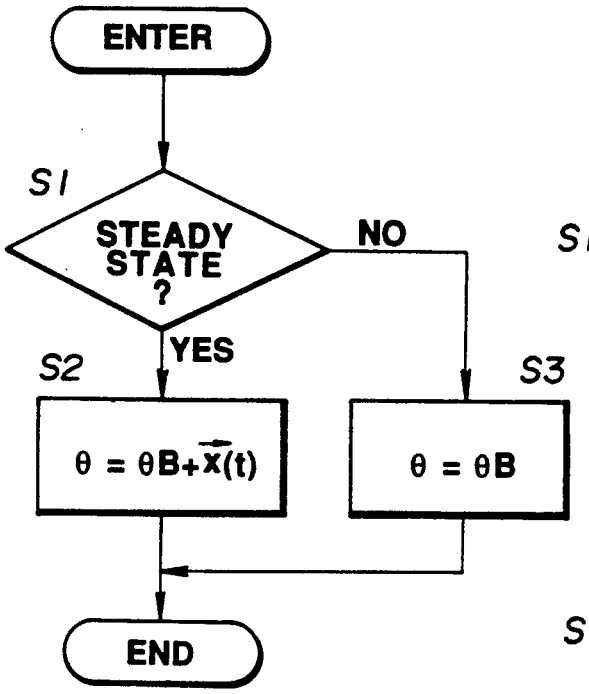
FIGS. 3, 4, 5 (A), and 5 (B) are operational flowcharts executed by the diagnostic system and ignition system.
Figure 4:
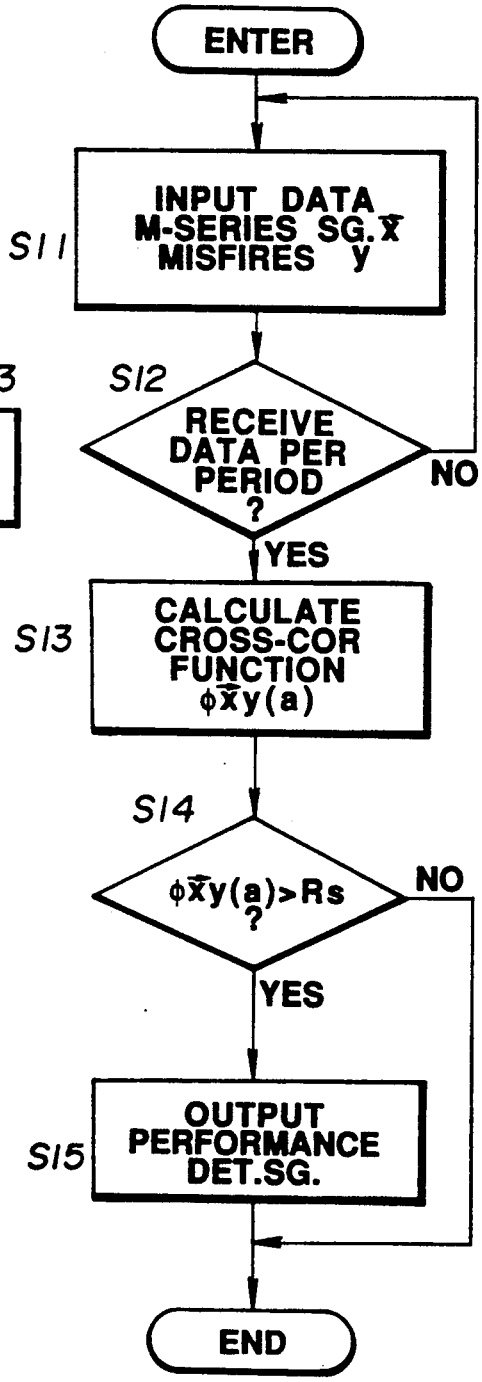

The control unit 5 diagnoses whether deterioration of ignition system has occurred in accordance with FIGS. 3 and 4.

FIG. 3 shows a program routine to superpose an M-series sequence signal, one type of periodic pseudo random signal, on the signal representing the dwell angle.

In a step S1, the control unit 5 determines whether the driving condition falls in a steady state. If the engine falls in the steady state in the step S1, the routine goes to a step S2. If not in the steady state, the routine goes to a step S3.

In a step S2, the control unit 5 serves as a function of the signal superposing block 28. In this case, the M-series sequence signal $\vec{x}(t)$ is superposed on the dwell angle as will be described later $\theta B$ [°].

That is to say, the dwell angle $\theta$[°] is calculated using the following equation:

$$\theta = \theta B + x(t) \quad (1)$$

In a step S3, the dwell angle $\theta = \theta B$.

The M-series sequence signal $\vec{x}(t)$ is a periodic function having parameters, i.e., an amplitude a, minimum pulsewidth $\Delta$ (delta), and one period denoted by $N\Delta$ (N denotes a maximum sequence, in the first preferred embodiment, is 15 but may alternatively be 7, 3, and 1). Therefore, its auto-correlation function $\phi\vec{x}\vec{x}(\alpha)$ is also the periodic function.

Figure 6A:
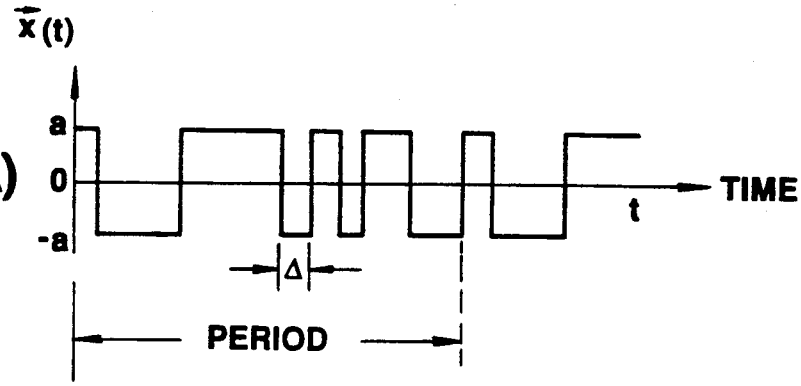
FIGS. 6 (A) and 6 (B) are waveform charts of a periodic psuedo random signal and its auto-correlation function.
Figure 6B:
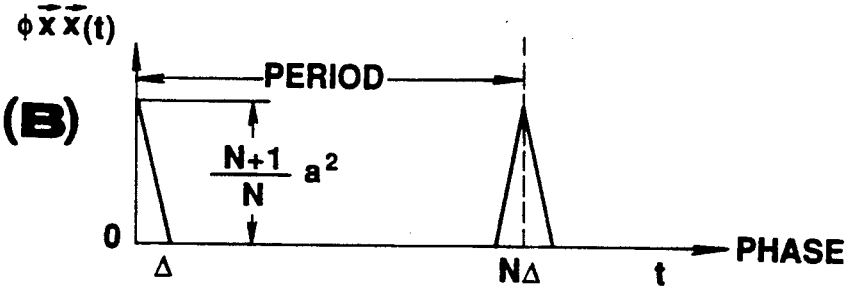

As shown in FIG. 6 (B), the auto-correlation function is a periodic pulse train of a triangular shape of narrow width.

The M-series sequence signal is a minute signal and does not affect a driver's vehicle handling, or the 'feel' of vehicle operation, when superposed on the dwell angle signal.

It is noted that the periodic pseudo random signal is not limited to an M-series sequence signal but may alternatively be an L-series sequence signal or twin prime number sequence signal.

FIG. 4 shows a program routine to diagnose the deterioration of the ignition system.

The routines shown in FIGS. 3 and 4 are executed at regular times or in response to an interrupt request.

In a step S11, the control unit 5 stores the data on the M-series sequence signal and the number of misfires y, based on the M-series sequence signal at a constant interval.

Figure 7:
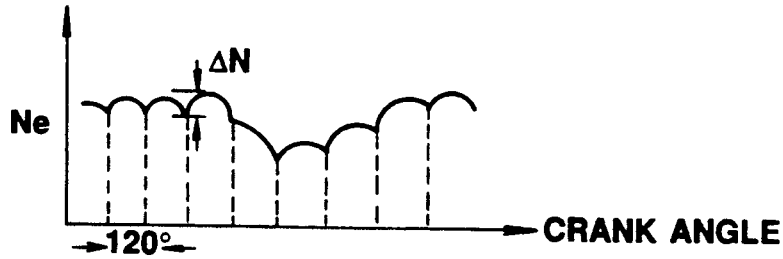
FIG. 7 is a waveform chart of a change pattern in an engine revolutional speed for explaining an occurrence of misfiring.

The control unit 5 determines whether misfiring occurs by monitoring the engine revolutional speed Ne. FIG. 7 shows a change pattern of the engine revolutional speed Ne. Suppose that the change in the revolutional speed per 120 [°] crank angle interval is ΔN. If misfiring occurs, the value of ΔN exceeds a predetermined value Ns. If $\Delta N \geqq Ns$, the control unit 5 can determine that a misfire has occurred.

Hence, the number of misfires per predetermined period of time is the number of occurrences of misfiring.

Figure 8A:
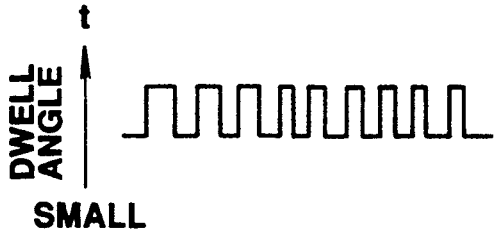
FIGS. 8 (A) and 8 (B) are waveform charts for explaining a change pattern of a dwell angle with respect to a number of occurrences of misfires.
Figure 8B:
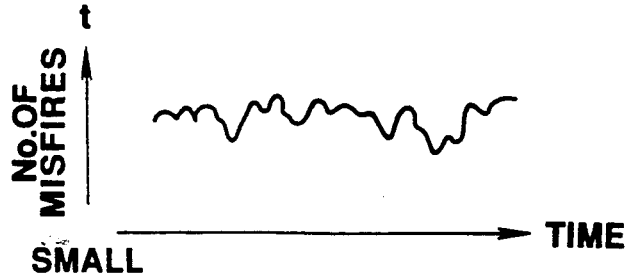

FIGS. 8 (A) and 8 (B) show the change in the dwell angle on which the M-series sequence signal is superposed and a minute change in the number of occurrences of misfiring.

An output in a case where the M-series sequence signal is superposed is not limited to the number of occurrences of misfiring but may be output in relation to deterioration of the ignition system.

In a step S12, the control unit 5 determines whether the input data period of the M-series sequence signal $\vec{x}$ is ended. If ended in the step S12, the routine goes to a step S13.

The step S13 serves as the cross-correlation function calculating block 30 in FIG. 1.

The cross-correlation function $\phi\vec{x}y$(alpha α) between $\vec{x}$ and y per predetermined period of time can be calculated from the following equation:

$$\phi xy(\alpha) = \int_0^{N\Delta} y(t) \times x(\alpha - t)dt \quad (2)$$

In an actual practice, digital signal processing (DSP) is carried out within the control unit 5. The right term of the equation (2) can be converted into an integrated value. The actual control system is constituted by a discrete value system.

In a step S14, the control unit 5 serves as the deterioration determining block 31. In the step S14, the control unit 5 compares the cross-correlation function $\phi\vec{x}y(\alpha)$ derived in the step S13 with the reference value Rs to determine whether deterioration has occurred. If $\phi\vec{x}y(\alpha) \geqq Rs$, the control unit 5 determines that deterioration has occurred and the routine goes to a step S15.

The reason that $\phi\vec{x}y(\alpha) \geqq Rs$ indicates that deterioration has occurred will be described below.

Now, suppose that no deterioration has occurred. In this case, if a small change of the dwell angle occurs, the number of occurrences of misfiring is not correspondingly increased. However, when deterioration of the ignition system occurs, a slight change in the dwell angle causes increase in the number of occurrences of misfiring. In other words, a relationship between the dwell angle and the number of occurrences of misfiring becomes close (the value of cross-correlation function is increased).

Figure 9:
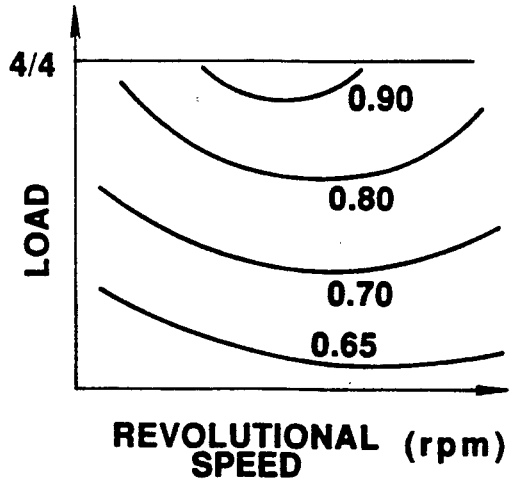
FIG. 9 is a characteristic graph of a reference value used in a second preferred embodiment according to the present invention in which the diagnostic system has been applied to the ignition system.

The contents of the reference value Rs are shown in FIG. 9. As shown in FIG. 9, the reference value is variably set according to the engine load and engine revolutional speed Ne. This is because when a combustion state is preferable under a high load region, no misfiring will probably occur due to trouble in a system except for the ignition or fuel injection systems. In other words, since the deterioration of the ignition system largely affects misfiring, the value of Rs is increased in the high load region.

Conversely, in a low load region, misfiring often occurs due to a presence of residual gas, and/or valve timing. This is because other causes are added except deterioration of the ignition system. A correlation between the deterioration of the ignition system and misfiring is decreased. Therefore, the value of Rs is decreased under the low load region.

In a step S15, the control unit 5 serves as the determination result output block 32 of FIG. 1. When the output representing the occurrence of deterioration appears, the output causes a lamp installed on an instrument panel of the vehicle to be turned on.

Figure 5A:
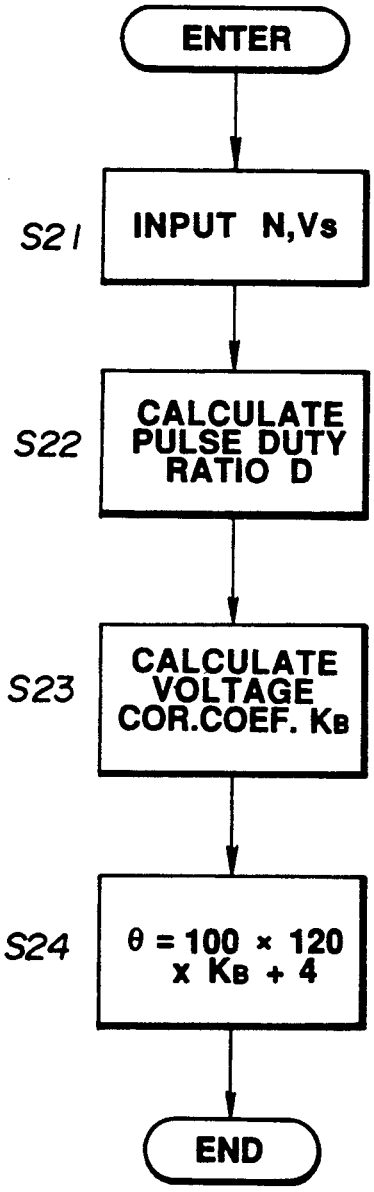
Figure 5B:
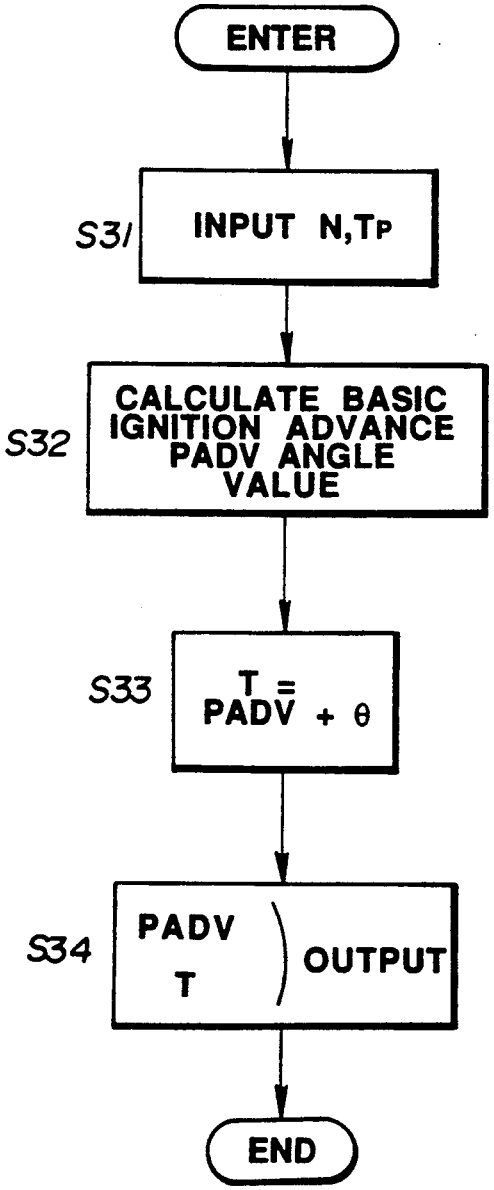

FIG. 5 (A) shows a program routine executed by the control unit 5 to calculate the dwell angle θ. The program shown in FIG. 5 (A) serves as the dwell angle calculating block 24 of FIG. 1.

In a step S21, the control unit 5 reads the engine revolutional speed Ne and battery voltage Vs. In steps S22 and S23, the control unit 5 refers to a map to derive the dwell angle signal duty ratio D % and a battery voltage correction coefficient $K_B$.

Figure 11:
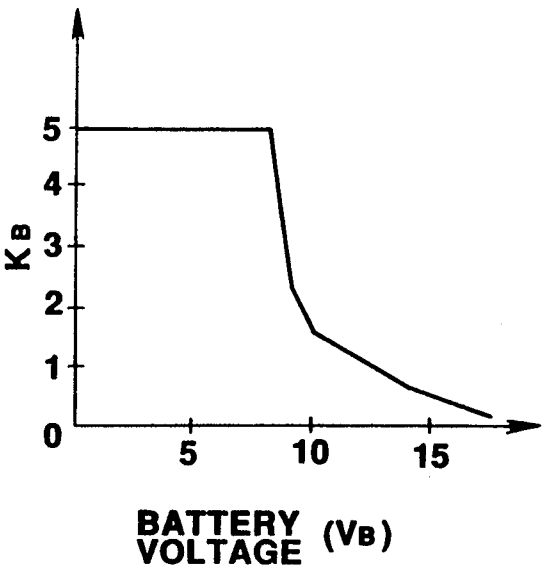
FIG. 11 is a characteristic graph of a battery voltage correction coefficient.
Figure 10:
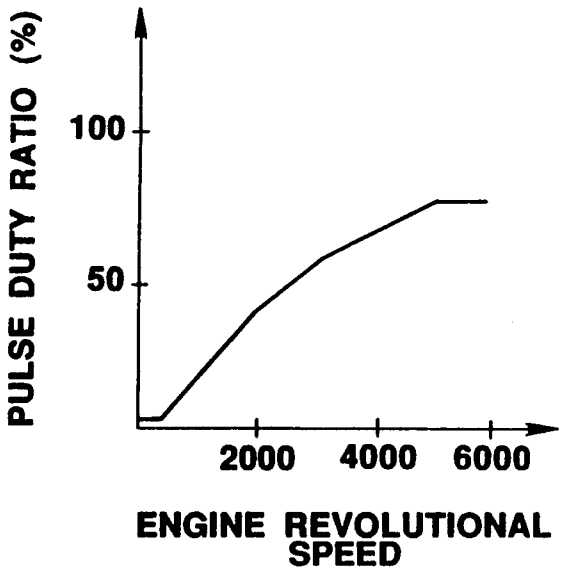
FIG. 10 is a characteristic graph of a dwell angle pulse duty ratio.

FIGS. 10 and 11 show respective mapping values of the dwell angle signal duty ratio D and battery voltage correction coefficient $K_B$. In FIG. 10, the reason that the dwell angle is decreased during low engine revolutional speeds is to prevent an additional primary current from flowing through each primary winding of the ignition coil. In addition, as the engine revolutional speed is increased, the dwell angle is increased to prevent a reduction of secondary current.

In a step S24, the control unit 5 calculates the dwell angle θ[°] from the following equation:

$$\theta = (D/100) \times 120 \times K_B + 4 \quad (3)$$

FIG. 5 (B) shows a program routine to carry out the ignition timing control.

In steps S31 and S32, the control unit 5 serves as the basic ignition timing controlling block 23 of FIG. 1. In a step S31, the control unit 5 reads an engine revolutional speed Ne and a basic pulsewidth Tp ($Tp = K \times Qa/Ne$, provided that K denotes a constant) as an engine load. In a step S32, the control unit 5 refers to a map and derives a basic ignition advance angle [°BTDC] PADV as the basic ignition timing.

In a step S33, the control unit 5 determines a falling edge of the ignition signal T [°BTDC] from the following equation (4).

$$T = PADV + \theta \quad (4)$$

In a step S34, the values of PADV and T are output to an I/O interface provided in a control unit 5. The I/O interface falls at a timing of T and generates the ignition signal falling at the timing of PADV. The I/O interface serves as the ignition signal generating block 25 in FIG. 1.

FIGS. 3, 4, 5 (A), and 5 (B) show program routines provided for a CPU (Central Processing Unit) within the control unit 5.

Figure 12:
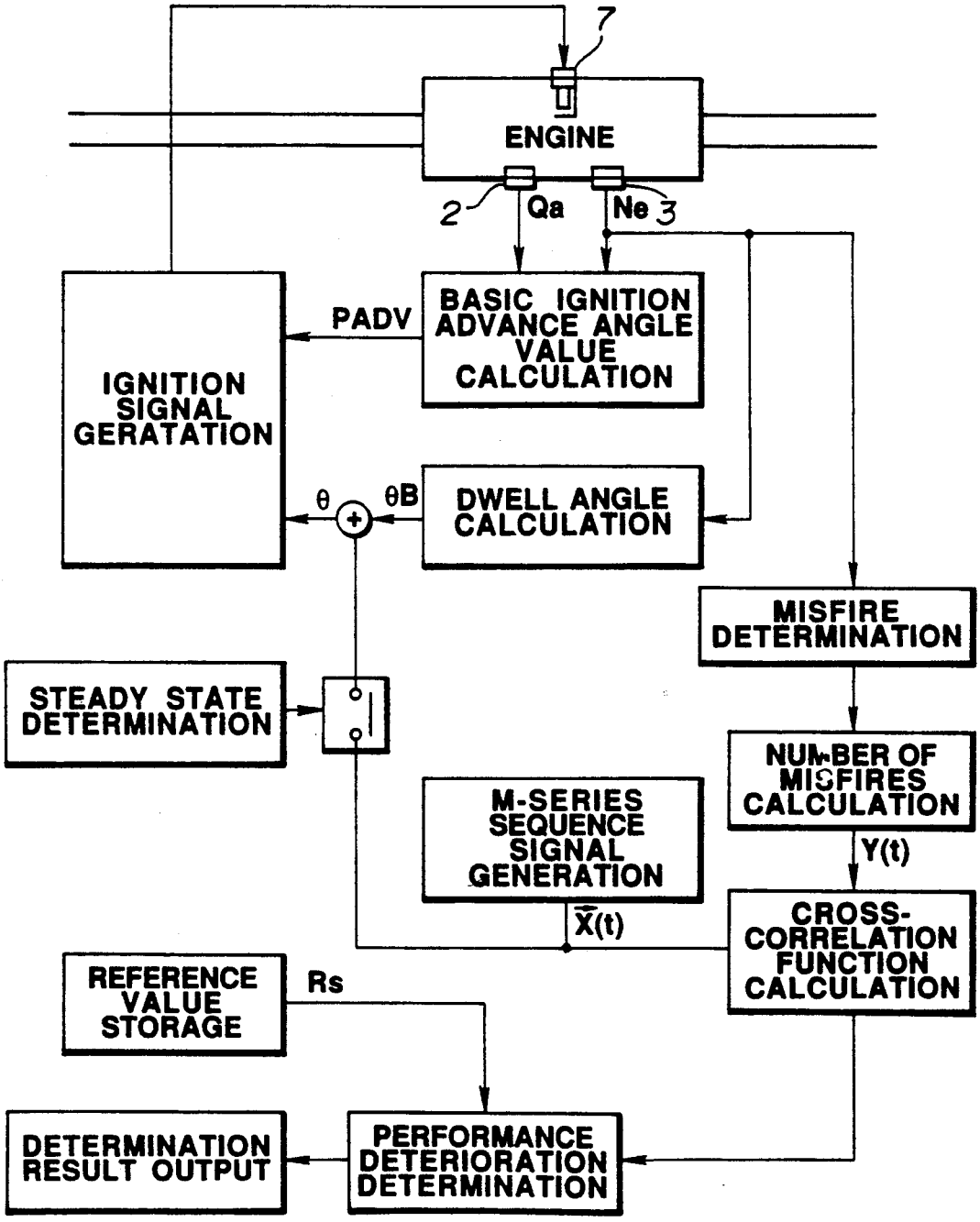
FIG. 12 is a schematic circuit block diagram of the diagnostic system in the second preferred embodiment according to the present invention which is applicable to an ignition system.

FIG. 12 shows the diagnostic system applicable to the ignition system of the engine in a second preferred embodiment.

An operation of the first and second preferred embodiments will be described below.

In the first and second preferred embodiments, a magnitude of the deterioration in the ignition system can be grasped by the cross-correlation function $\phi\bar{x}y(\alpha)$ between the M-series sequence signal $\bar{x}$ which minutely changes the dwell angle and the number of occurrences of misfiring y.

Since as the deterioration of the ignition system is advanced, the number of occurrences of misfiring is increased in a case when the dwell angle is changed. The relationship between the dwell angle and the number of occurrences of misfiring becomes close and the value of the cross-correlation function $\phi\bar{x}y$ becomes increased.

Hence, as the deterioration in the ignition system is advanced to a degree such as to exceed a limit over which the performance of the ignition system cannot be maintained, the value of cross-correlation function $\phi\bar{x}y(\alpha)$ exceeds the reference value Rs defined as the limit value. Then, the warning lamp is turned on. The turning on of the lamp can alert the driver that the ignition system has deteriorated.

If repair is carried out in response to the turning on of the warning lamp, it is possible to return the ignition system to a normal state before a critical failure (no ignition) results. In detail, since the performance of the ignition system can be monitored, appropriate measures should be taken when deterioration has been determined.

Since in a previously proposed ignition system, no monitor function is installed, the driver would continue to drive without being aware of the deterioration of the ignition system.

It is noted that it is not so important to check to determine which of the parts constituting the ignition system has deteriorated. It is sufficient to check each part of the ignition system at a repairing factory in a case where the deterioration is diagnosed. That is to say, the diagnostic system according to the present invention checks the ignition system to determine whether the present ignition system as a whole is safe to use from the point of view of driving safety. Since driving cannot be carried out unless the whole ignition system performance can be maintained. The diagnostic system according to the present invention does not determine which of the parts constituting the ignition system has deteriorated or requires maintenance.

Although the M-series sequence signal is superposed during driving, the level and period are minute and the superposition is carried out during a steady state condition of the engine. Therefore, engine driveability is not disturbed.

As shown in FIG. 9, since the reference value Rs is varied according to engine load, the diagnostic system and method can more accurately determine the occurrence of deterioration in the ignition system.

It is noted that the structure of the M-series sequence signal generating block is exemplified by U.S. Pat. No. 4,674,084 issued on Jan. 16, 1987 and U.S. Pat. No. 4,694,294 issued on Sep. 15, 1987, the disclosures of which are herein incorporated by reference. The structure of the ignition timing controlling system is exemplified by a U.S. Pat. No. 4,640,249 issued on Feb. 3, 1987, the disclosure of which is also herein incorporated by reference.

Third and Fourth Preferred Embodiments

Figure 13:
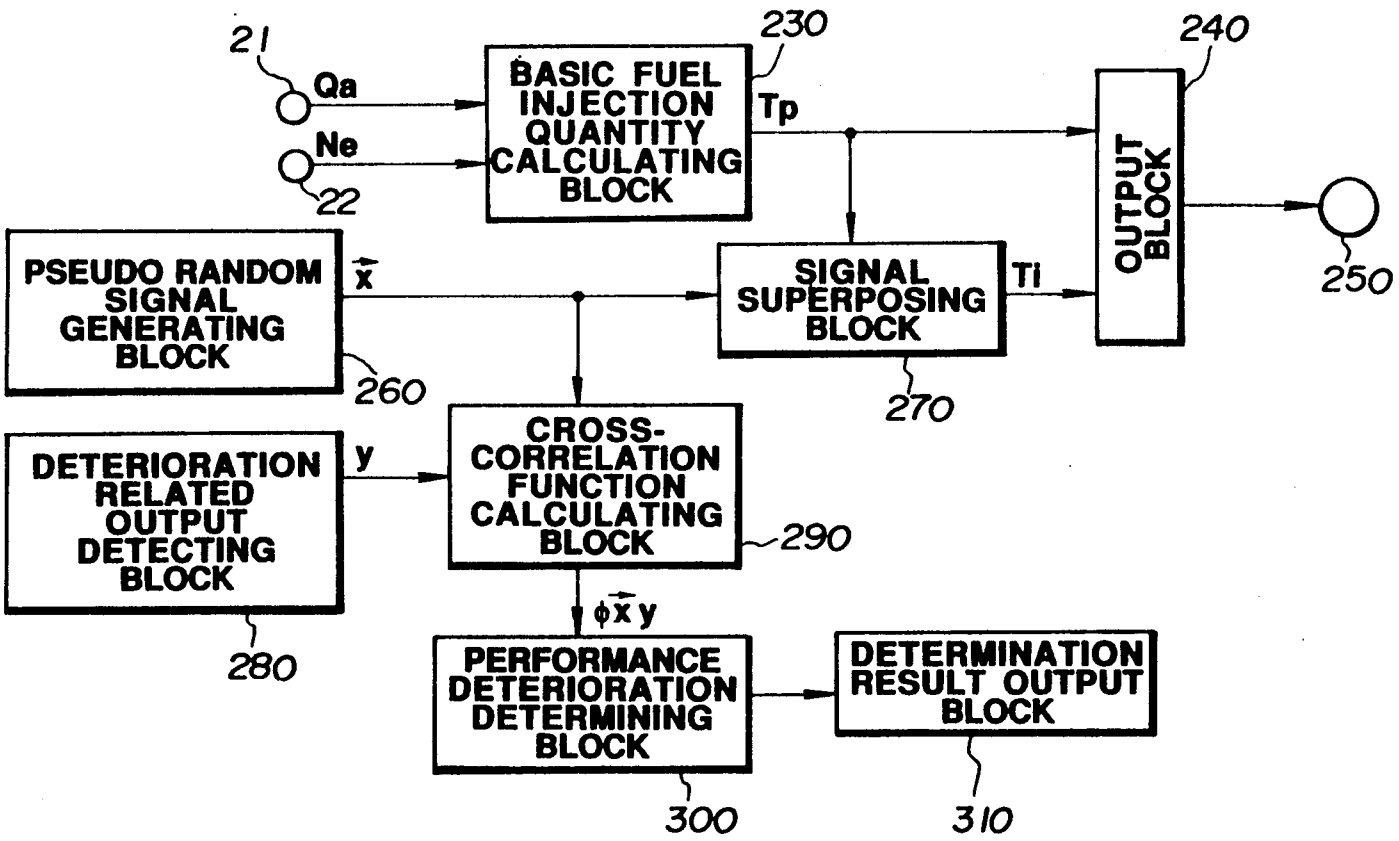
FIG. 13 is a schematic functional block diagram of a diagnostic system in a third preferred embodiment according to the present invention.

FIG. 13 shows a functional circuit block diagram of a third preferred embodiment in which the diagnostic system is applicable to a fuel injection system.

The two sensors 21 and 22 are installed for detecting the engine load (for example, intake air quantity Qa) and engine revolutional speed Ne.

A basic fuel injection quantity Tp calculating block 230 is installed for calculating a basic fuel injection quantity Tp on the basis of the detected values from the two sensors 21 and 22. An output block 240 outputs the basic fuel injection quantity Tp to a fuel injection device 250.

A periodic pseudo random signal generating block 260 generates the periodic pseudo random signal (for example, the M-series sequence signal $\bar{x}$). A superposing block 270 superposes the periodic pseudo random signal on a signal representing the basic fuel injection quantity Tp. An output block 280 detects an output related to the deterioration of the fuel injection system (for example, the number of occurrences of misfiring y). A calculating block 290 calculates a cross-correlation function $\phi\bar{x}y$ from the output y and pseudo random signal $\bar{x}$. A determining block 300 determines that the deterioration in the fuel injection device 250 has occurred when the cross-correlation function $\phi\bar{x}y$ exceeds the reference value Rs. An output block 310 outputs the result of determination of deterioration.

It is noted that the fuel injection system is exemplified by a U.S. Pat. No. 4,782,806 issued on Nov. 8, 1988, the disclosure of which is herein incorporated by reference.

Figure 14:
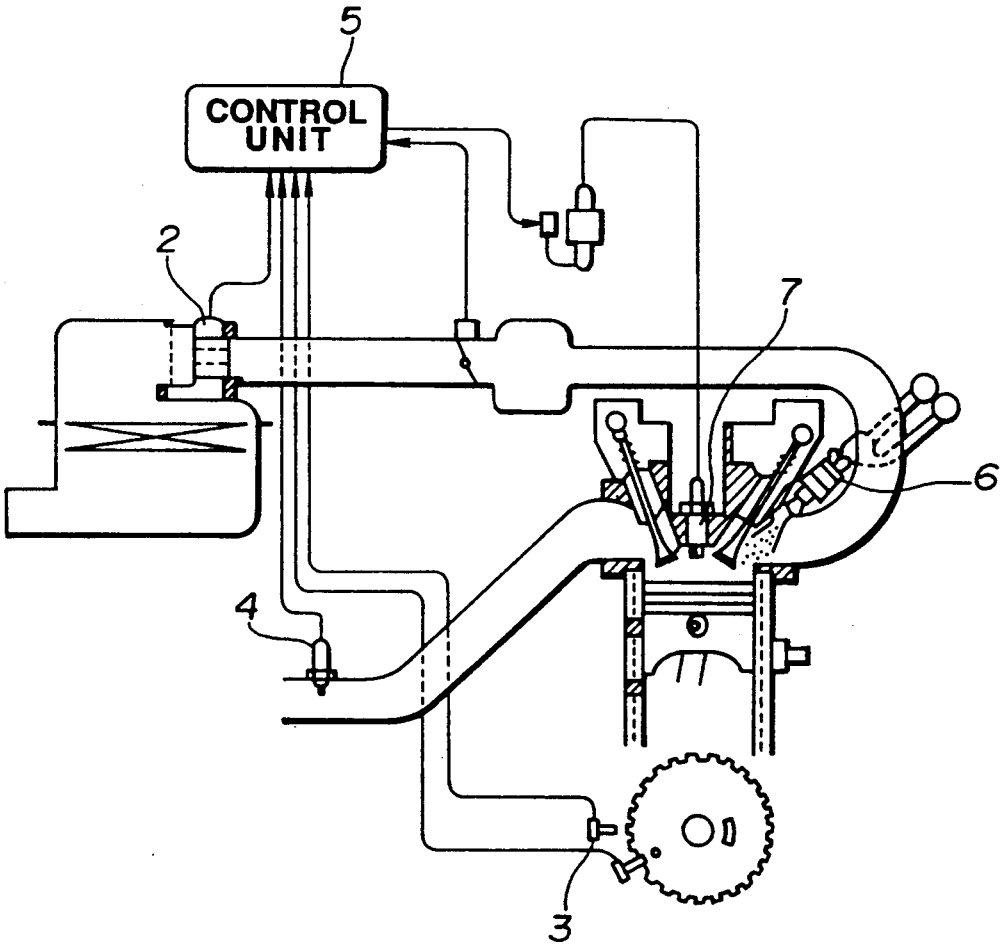
FIG. 14 is a schematic drawing of the diagnostic system of the fuel injection system shown in FIG. 13.

FIG. 14 shows a system configuration of the diagnostic system for the fuel injection system of the engine.

An intake air quantity Qa is detected by means of an airflow meter 2. An engine revolutional speed Ne is detected by means of a crank angle sensor 3. An air-fuel mixture ratio in the exhaust gas is detected by means of an air-fuel mixture ratio sensor 4. These signals are input to the control unit 5. The control unit 5 supplies the fuel injection signal to the solenoid of the injector 6. The control unit 5 calculates a fuel injection pulsewidth corresponding to a valve opening duration of time of the fuel injector 6 in accordance with FIG. 17. The control unit 5 diagnoses the fuel injection system to determine whether the deterioration occurs in accordance with the steps shown in FIGS. 15 and 16.

Figure 15:
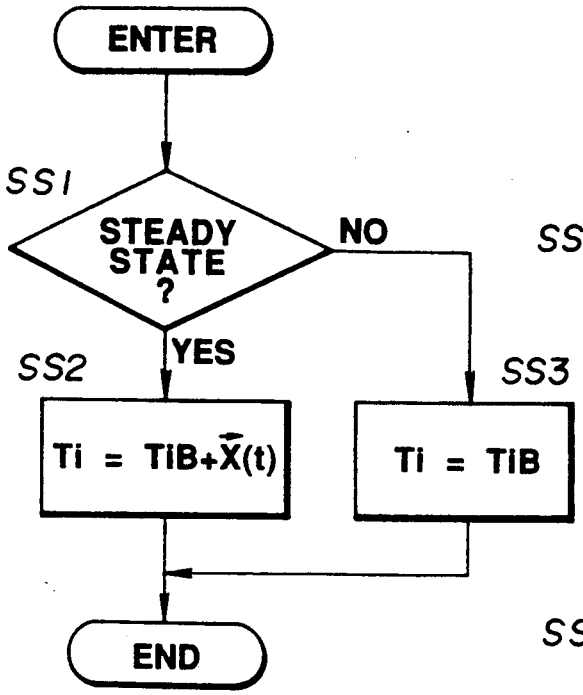
FIGS. 15, 16, and 17 are operational flowcharts of the diagnostic system applicable to the fuel injection system shown in FIG. 13.

FIG. 15 shows a program routine executed by the control unit 5 in order to superpose the M-series sequence signal, one of the pseudo random signals, on the fuel injection signal.

In the same way as shown in FIG. 3, in the step SS1, the control unit 5 determines whether the engine driving condition falls in the steady state condition. If the engine falls in the steady state condition in the step SS1, the routine goes to the step SS2. If not in the steady state, the routine goes to the step SS3.

The step SS2 serves as the signal superposing block 280 shown in FIG. 13. In the step SS2, the control unit 5 superposes the M-series sequence signal $\bar{x}(t)$ on a fuel injection pulsewidth TiB [ms] calculated by a previously proposed fuel injection quantity control system.

The fuel injection pulsewidth TiB will be described in detail hereinlater.

The fuel injection pulsewidth Ti[ms] is calculated as follows:

$$Ti = TiB + x(t) \quad (4)$$

When the pulsewidth Ti is supplied to the fuel injector 6, the fuel injector 6 injects fuel toward an intake port of the engine.

It is noted that the I/O interface located within the control unit 5 outputs the pulsewidth Ti. The I/O interface serves as the output block 240.

On the other hand, in the step S3, Ti=TiB.

Figure 18A:
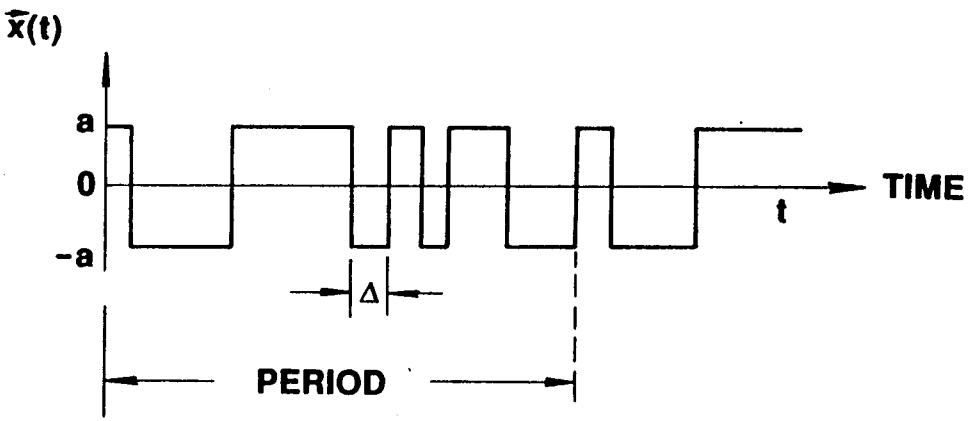
FIGS. 18 (A) and 18 (B) are waveform charts of the M-series sequence signal utilized in the system of the present invention and its auto-correlation function.
Figure 18B:
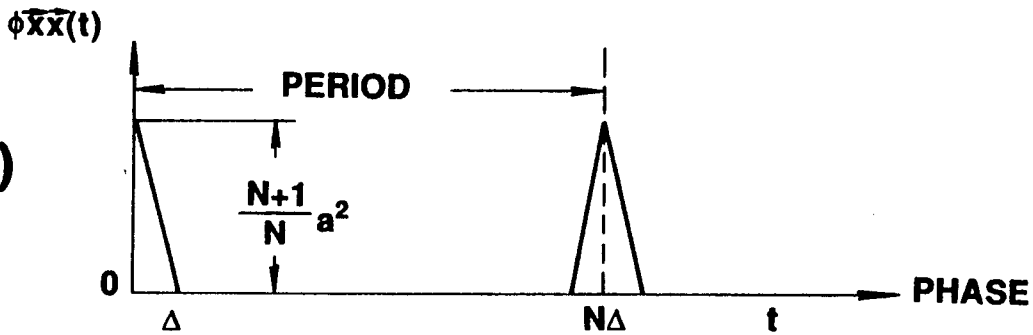

FIGS. 18 (A) and 18 (B) show the M-series sequence signal $\bar{x}(t)$ and its auto-correlation function as used in the third preferred embodiment.

Figure 16:
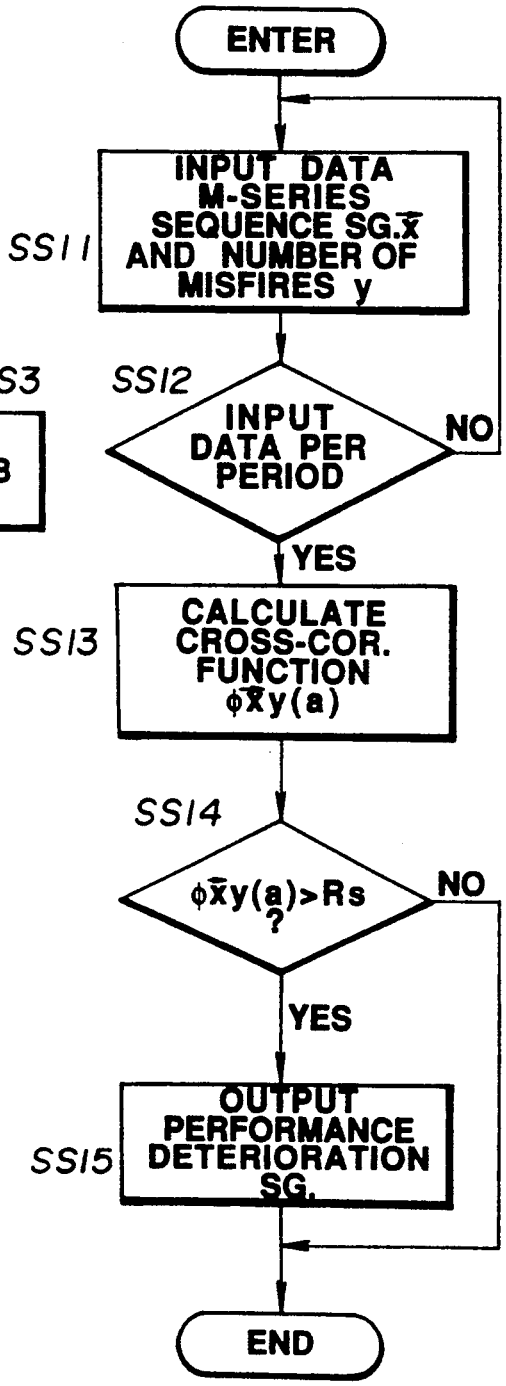

FIG. 16 shows a program routine executed by a control unit 5 to diagnose deterioration in the fuel injection system.

The program routines of FIG. 15 and FIG. 16 are executed by the control unit 5 at the regular intervals or in response to an interrupt request.

In a step SS11, the control unit 5 stores input data on the M-series sequence signal $\bar{x}$ and the number of occurrences of misfiring y.

The control unit 5 determines whether misfire occurs depending on engine revolutional speed change.

Figure 19:
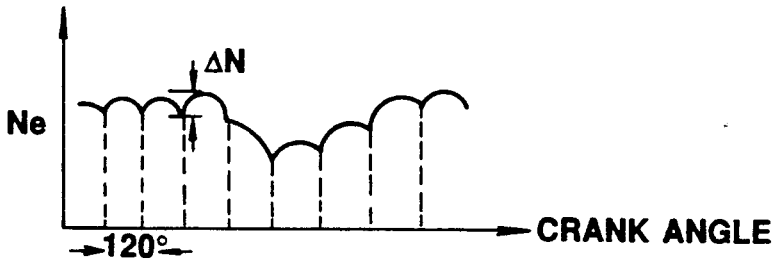
FIG. 19 is a waveform chart of the change pattern of the engine revolutional speed for explaining an occurrence of misfiring.

FIG. 19 shows a change pattern of the engine revolutional speed Ne. 120° crank angular position range indicates an engine stroke for each cylinder. The change in engine revolutional speed is denoted by ΔN. If misfire occurs, the data of ΔN exceeds the predetermined value Ns. The control unit 5 can determine that misfire occurs if N≧Ns.

Figure 20A:
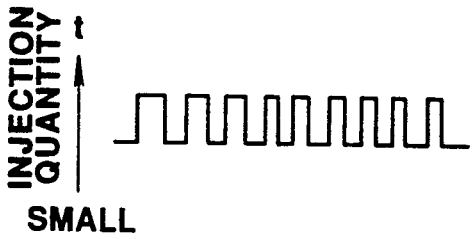
FIGS. 20 (A) and 20 (B) are waveform charts of a fuel injection quantity in relation to a number of occurrences of misfiring.
Figure 20B:
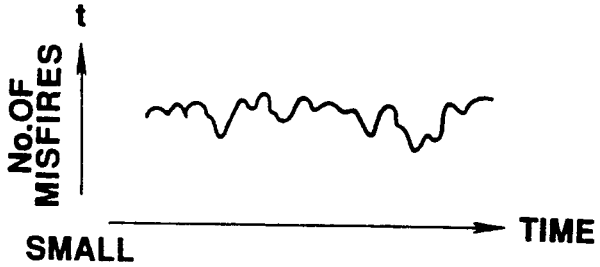

FIGS. 20 (A) and 20 (B) show the change in the fuel injection quantity on which the M-series sequence signal is superposed and show a minute change in the number of misfires.

The output in the case when the M-series sequence signal is superposed is not limited to the number of occurrences of misfiring but may be an output related to the deterioration of the fuel injection system.

In a step SS12, the control unit 5 determines whether the data input period of the M-series sequence signal $\bar{x}$ is ended. If ended, the routine returns to the step SS13.

The step SS13 serves as the cross-function calculating block 290.

In the step SS13, the control unit 5 calculates the cross-correlation function $\phi\bar{x}y(\alpha)$ using the following equation:

$$\phi xy(\alpha) = \int_0^{N\Delta} y(t) \times x(\alpha - t)dt \quad (5)$$

In a step SS14, the control unit 5 serves as the deterioration determining block 300 in FIG. 1. In the step SS14, the control unit 5 compares the cross-correlation function with the reference value.

If $\phi\bar{x}y(\alpha)$≧Rs, the control unit 5 determines occurrence of misfiring and the routine goes to a step SS15.

The reason that the control unit 5 determines the occurrence of deterioration when $\phi\bar{x}y$≧Rs will be described below.

Suppose that no deterioration in the fuel injection system, in such case, the number of occurrences of misfiring is not increased even if the fuel injection quantity is slightly or largely changed. However, if deterioration occurs due to clogging of the fuel injector or fuel distribution passage, the desired fuel injection quantity cannot be supplied even if a slight change in the fuel injection quantity occurs. Therefore, the air-fuel mixture supplied to the engine becomes lean and the number of occurrences of misfiring is increased. That is to say, if deterioration of the fuel injection system occurs, the relationship between the fuel injection quantity and the number of misfires becomes closer (the value of the cross-correlation function becomes increased).

Figure 21:
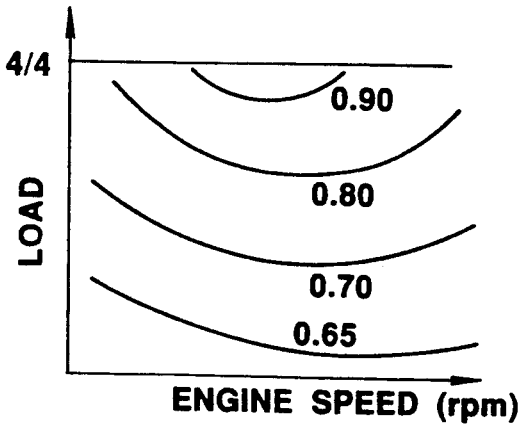
FIG. 21 is a characteristic graph of a reference value used in a fourth preferred embodiment of the diagnostic system, applicable to a fuel injection system.

The contents of the reference value Rs are shown in FIG. 21. As the engine revolutional speed Ne and engine load are varied, the reference value Rs is varied.

The reason is that the reference value Rs is varied is, since the combustion state is preferable under a high load condition, misfiring does not occur in the fuel injection system for reasons other than a problem with the ignition system. In other words, misfiring under a high load condition is effected largely by deterioration in the fuel injection system. Therefore, the value of Rs is increased under high load conditions.

Conversely, misfiring may occur due to residual gas or valve timing anamolies of the intake and/or exhaust valves under low load conditions. Therefore the correlationship between deterioration of the fuel injection system and misfiring is decreased. Accordingly the value of Rs is decreased under low load conditions.

In a step SS15, the control unit 5 serves as the determination result output block 310. The result of determination in the deterioration is output. For example, a warning lamp installed on the instrument panel is turned on.

Figure 17:
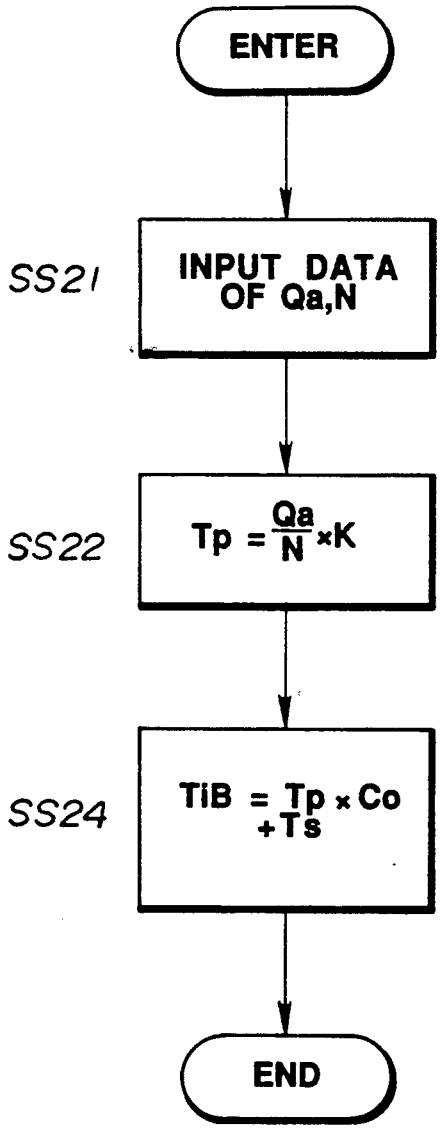

FIG. 17 shows a program routine executed by the control unit 5 to calculate the fuel injection pulsewidth.

In steps SS21 and SS22, the control unit 5 serves as the basic fuel injection quantity calculating block 230.

In steps SS21 and SS22, the control unit 5 reads the intake air quantity Qa and revolutional speed Ne and the control unit 5 calculates the basic fuel injection pulsewidth Tp (=K⊔Qa/Ne, wherein K denotes the constant).

The control unit 5 calculates the fuel injection pulsewidth TiB from the following equation:

$$TiB = Tp \times Co + Ts \quad (6)$$

In the equation (6), Co denotes a sum of a coolant temperature correction coefficient plus 1, and Ts denotes an ineffective pulsewidth.

Figure 22:
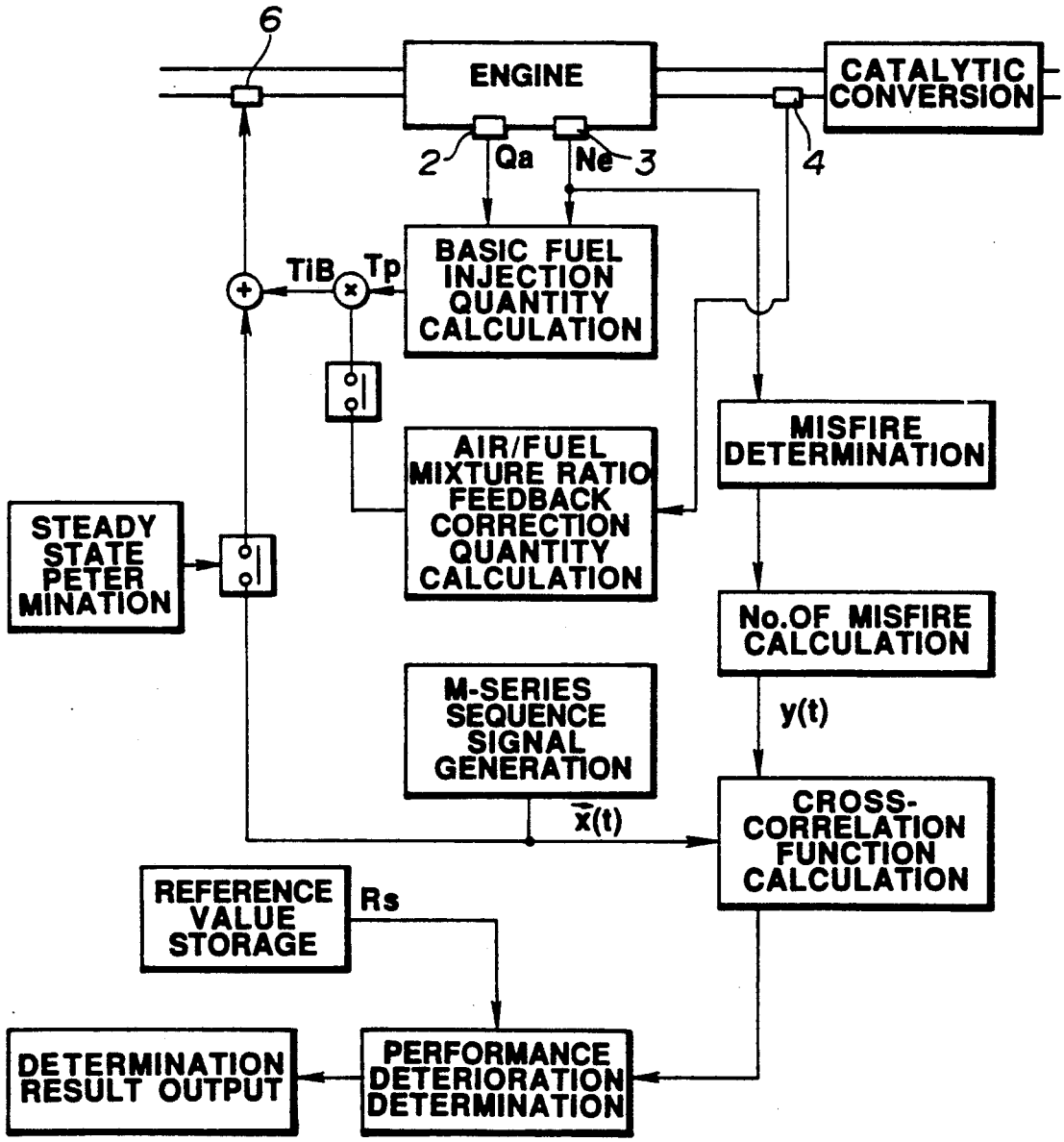
FIG. 22 is a schematic circuit block diagram of the diagnostic system of the fuel injection system in the fourth preferred embodiment.

The program routines executed by the control unit 5 are shown in FIGS. 15 through 17, but are converted to operate in the manner shown in the circuit block diagram shown in FIG. 22.

Operation of the third and fourth preferred embodiments will be described below.

In the third and fourth preferred embodiments, a magnitude of the deterioration in the fuel injection system can be determined via the cross-correlation function $\phi\bar{x}y(\alpha)$ between the M-series sequence signal $\bar{x}$ which minutely changes the injection quantity and the number of occurrences of misfiring y.

Since, as the deterioration of the fuel injection system is advanced, the number of occurrences of misfiring is increased in a case when the fuel injection quantity is changed, the relationship between the fuel injection quantity and the number of occurrences of misfiring becomes closer and the value of the cross-correlation function $\phi\bar{x}y$ is increased.

Hence, as the deterioration in the fuel injection system advances to a degree over which the performance of the fuel injection system cannot be maintained, the value of cross-correlation function $\phi\bar{x}y(\alpha)$ exceeds the reference value Rs defined as the limit value. Then, the warning lamp is turned on. The turning on of the lamp can signals a driver that the fuel injection system has deteriorated.

If repair is carried out promptly in response to the turning on of the warning lamp, it is possible to return the fuel injection system to a normal state before a critical failure (no fuel injection) results. Since the performance of the fuel injection system is monitored, appropriate measures may be taken when the deterioration has been determined.

Since in previously proposed fuel injection systems, no monitoring function is installed, a driver would continue to drive without being aware of the extent of deterioration of the fuel injection system.

It is noted that it is not so important to check to determine which of the parts constituting the fuel injection system have deteriorated. It is sufficient to check each part of the fuel injection system at a repairi facility after deterioration is diagnosed. That is to say, the diagnostic system according to the present invention checks the fuel injection system to determine whether the present condition of the fuel injection system is functional from the point of view of driving safety since driving cannot be carried out unless the whole fuel injection system performance can be maintained. The diagnostic system according to the present invention does not determine which of the parts constituting the fuel injection system has deteriorated or requires maintenance.

Although the M-series sequence signal is superposed during the engine driving, the level and period are minute and the superposition is carried out during steady state conditions. Therefore, engine driveability is not disturbed.

As shown in FIG. 21, since the reference value Rs is varied according to engine load, the diagnostic system and method can more accurately determine occurrence of deterioration in the fuel injection system.

Fifth and Sixth Preferred Embodiments

The structure of the EGR system is exemplified by U.S. Pat. No. 4,466,416 issued on Aug. 21, 1984, the disclosure of which is herein incorporated by reference.

Figure 23:
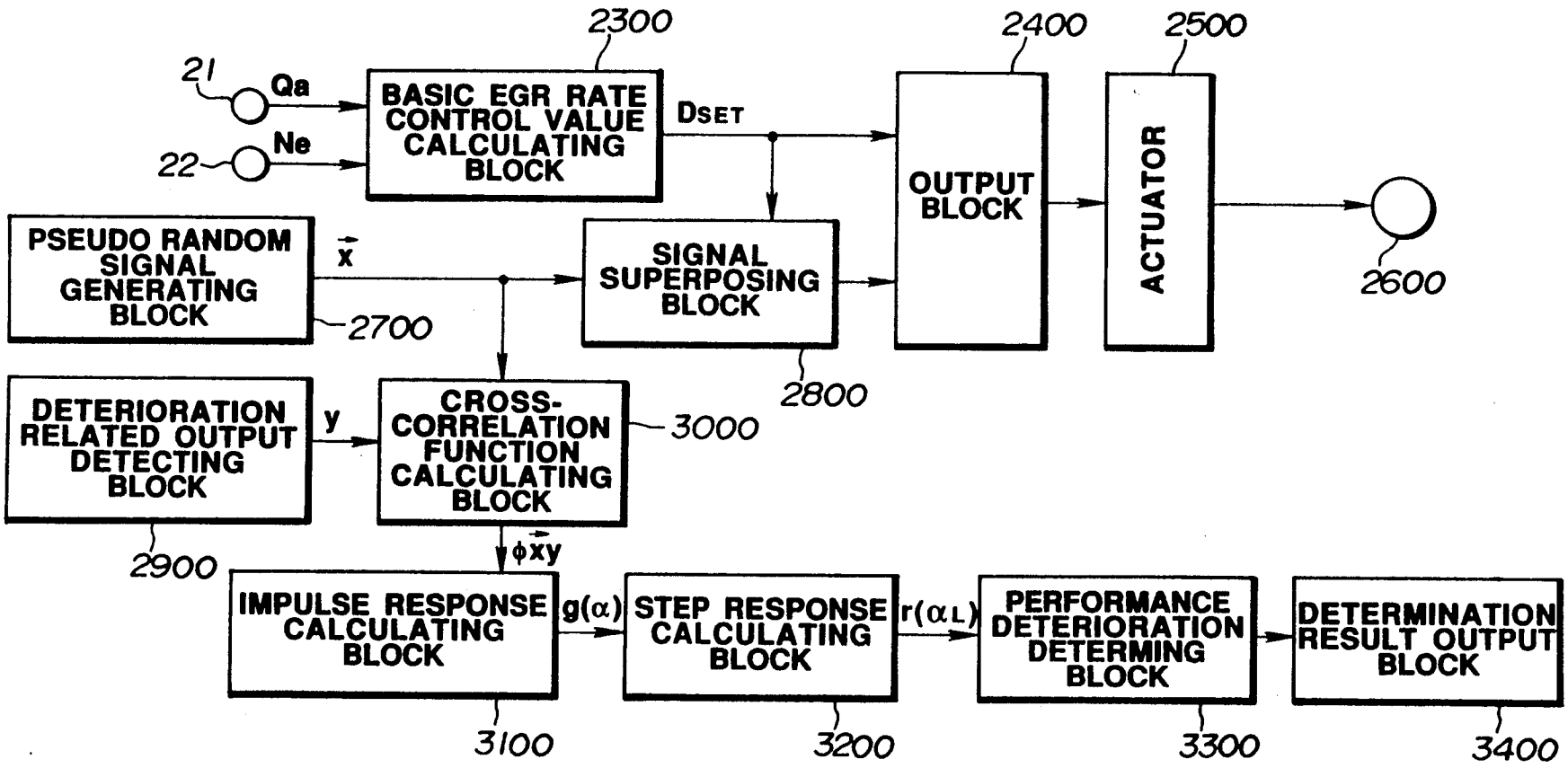
FIG. 23 is a functional circuit block diagram of the diagnostic system applicable to an EGR system of the internal combustion engine in a fifth preferred embodiment.

FIG. 23 shows the functional block diagram of an EGR system to which the diagnostic system of the fifth and sixth preferred embodiments is applicable.

Two sensors 21 and 22 are installed to detect engine load (intake air quantity Qa) and engine revolutional speed Ne, respectively. A basic EGR rate calculating block 2300 calculates a basic EGR rate controlled value $D_{SET}$ on the basis of these detected values. An output block 2400 outputs the controlled value $D_{SET}$. The EGR system further includes an actuator 2500 (for example, a negative pressure control electromagnetic valve) which opens the EGR control valve 2600 according to an output controlled value $D_{SET}$. A periodic pseudo random signal generating block 2700 generates the periodic pseudo random signal (for example, the M-series sequence signal $\bar{x}$). A superposing block 2800 superposes the periodic pseudo random signal on the signal representing the basic EGR rate controlled value. A detecting block 2900 detects an output (for example, a temperature at a downstream portion of the EGR control valve) related to deterioration in the EGR system and which is minutely changed due to the superposition of the periodic pseudo random signal. A calculating block 3000 calculates the cross-correlation function $\phi\bar{x}y$ from both the output y and pseudo random signal $\bar{x}$. A calculating block 3100 calculates an impulse response g ($\alpha$) from the cross-correlation function $\phi\bar{x}y$. A deriving block 3200 integrates the impulse response g ($\alpha$) to derive a step response r ($\alpha_L$). A determining block 3300 determines whether the EGR system has deteriorated according to the step response r ($\alpha_L$). An output block 3400 outputs the result of determination.

A correlation method in which the pseudo random signal is superposed on the control signal accurately is used to derive the step response.

Since the EGR system is a time delay system, the response gradually lags as deterioration advances. The performance as the EGR system cannot be maintained any more when the response reaches a certain threshold value.

In this case, if the step response is derived, the control unit 5 can easily determine the deterioration. For example, if the threshold value at a time $\alpha_L$ is defined as a reference value rs and then a value r($\alpha_L$) of the step response at the same time $\alpha_L$ is below rs, the control unit 5 can recognize that deterioration of the EGR system has occurred.

A lamp in the vehicle cabin, for example, may be turned on upon determination of the deterioration. Repair should then be promptly carried out for the EGR system. According to accurate monitoring of the EGR system, a vehicle operator may return the EGR system to normal condition before serious deterioration or system failure occurs.

Figure 24:
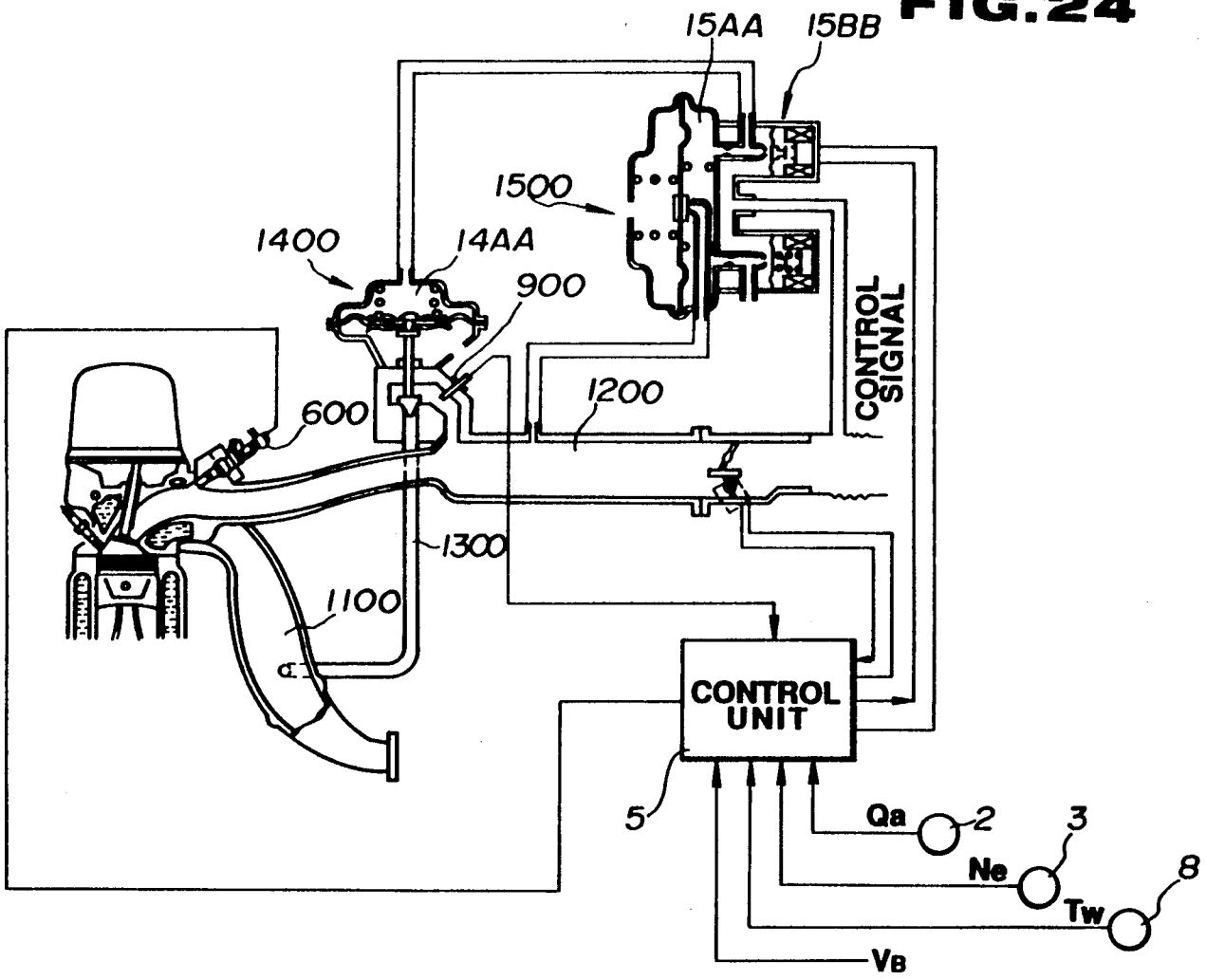
FIG. 24 is a schematic circuit drawing of the EGR system to which the fifth preferred embodiment of the diagnostic system is applicable.

FIG. 24 shows a system configuration of the EGR system and its control system. It is noted that, as shown in FIG. 24, a temperature sensor 9 (hereinafter referred to as an exhaust gas temperature sensor) is newly installed in a bypass passage 13 between the EGR control valve 14 and intake manifold 12 for detecting an exhaust gas temperature corresponding to the EGR rate.

In FIG. 24, the intake air quantity Qa is detected by means of the airflow meter 2. An engine revolutional speed Ne is detected by means of the crank angle sensor 3. A coolant temperature sensor 8 serves to detect a coolant temperature Tw. These detected signals are input to the control unit 5 together with the battery voltage Vs.

Figure 27A:
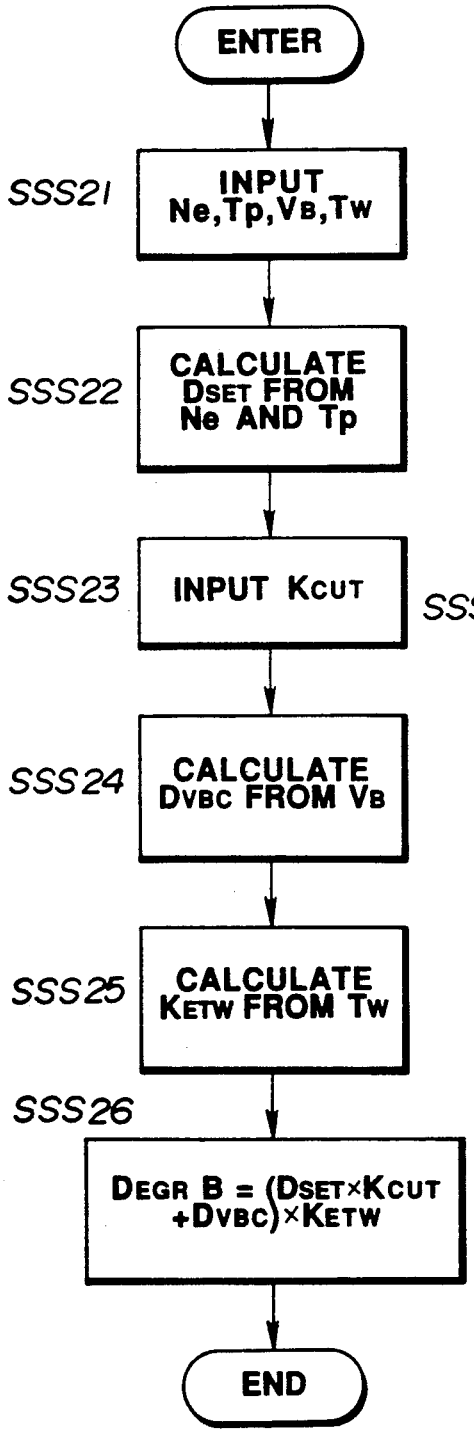
Figure 27B:
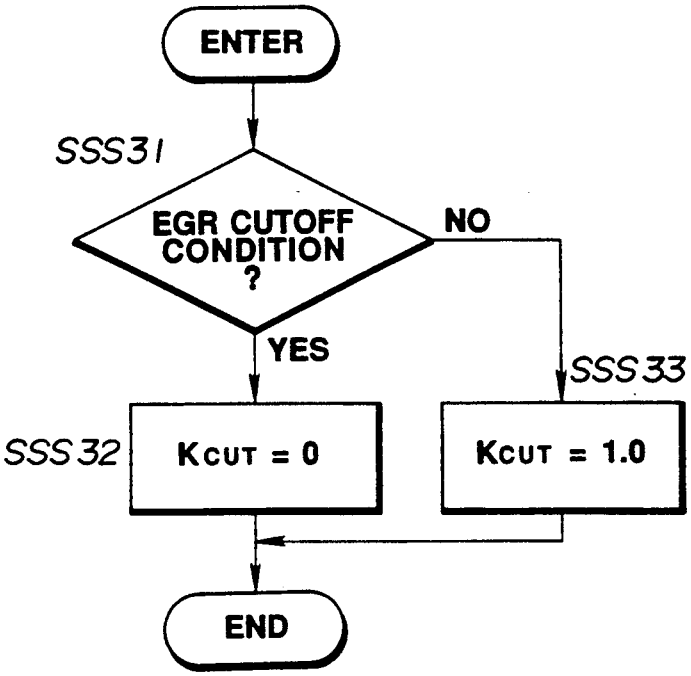

The control unit 5 calculates the EGR rate controlled value according to the instantaneous driving condition in accordance with the flowcharts of FIGS. 27(A) and 27(B).

Figure 25:
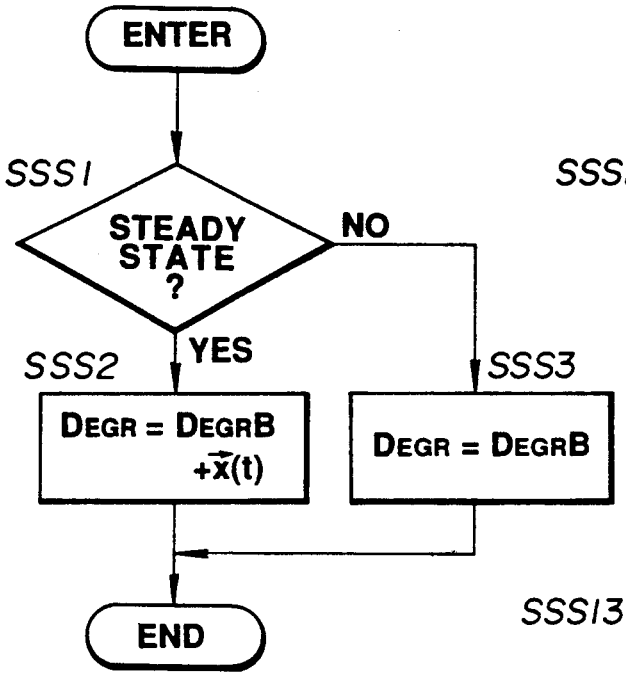
FIGS. 25, 26, 27 (A), and 27 (B) are operational flowcharts of the diagnostic system applicable to the EGR system of the engine in the fifth preferred embodiment shown in FIG. 24.
Figure 26:
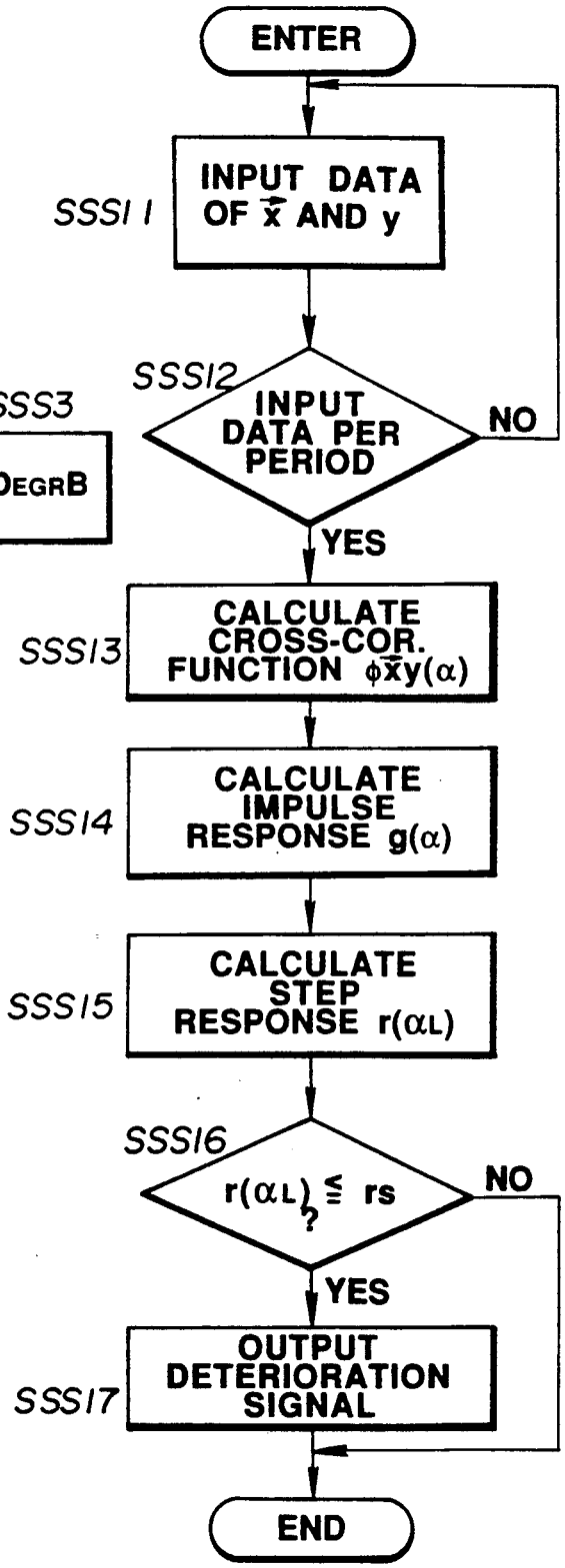

The control unit 5 serves to diagnose whether deterioration occurs in the EGR system in accordance with FIGS. 25 and 26.

The diagnosing operation by the control unit 5 for deterioration in the EGR system is not executed for discrete parts constituting the EGR system (for example, EGR control valve and negative pressure control electromagnetic valve) but for the whole of the EGR system.

The EGR system can generally be deemed as a time-lag type control system (of a first order).

Figure 33:
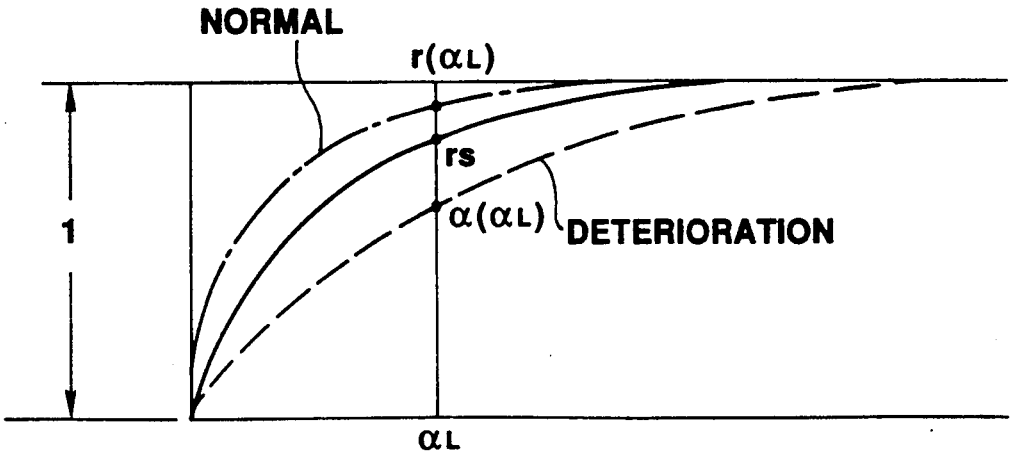
FIG. 33 is a characteristic graph of a cross-correlation function used in the fifth preferred embodiment of the diagnostic system applicable to the EGR system shown in FIGS. 23 and 24.

As shown in FIG. 33, step response of the EGR system is shown such that quick response (little or no deterioration) is denoted by a dot-and-dash line. As deterioration advances, the step response becomes delayed as denoted by a broken line.

Hence, if the actual step response of the EGR system is derived and an actual value of the step response at a predetermined time (for example, time $\alpha_L$) is compared with a reference value. If the actual value described above is below the reference value, the control unit 5 determines that deterioration in the EGR system has occurred.

The diagnoses of deterioration using step response can be accomplished in various ways, i.e., using comparison of a time constant.

It is noted that when step response is derived, a correlation method using a periodic pseudo random signal is applied thereto.

FIG. 25 shows a program routine executed by the control unit 5 in which an M-series sequence signal is superposed on the signal representing the EGR rate controlled value.

In a step SSS1, the control unit 5 determines whether the engine runs in a steady state.

In a step SSS2, the control unit 5 superposes the M-series sequence signal on the EGR rate controlled value $D_{EGR}B$ [%] calculated. In this case, the EGR rate controlled value $D_{EGR}$ [%] can be expressed as follows:

$$D_{EGR}=D_{EGR}B+x(t)$$

When the on-and-off pulse generated on the basis of the $D_{EGR}$ is applied to the solenoid of the solenoid valve portion 15 B, the negative pressure electromagnetic valve (actuator) 15 produces controlled negative pressure according to the value of $D_{EGR}$. The EGR control valve 14 opens the bypass passage 13 according to the controlled negative pressure. It is noted that $D_{EGR}$ denotes a value indicating a time percentage during which the solenoid valve portion 15B is OFF (i.e., valve closed) state. As the value of $D_{EGR}$ becomes large, the EGR control valve 14 widely opens.

The I/O interface of the control unit 5 outputs the value of $D_{EGR}$.

In the step SSS3 in FIG. 25, $D_{EGR}=D_{EGR}B$.

Figure 28A:
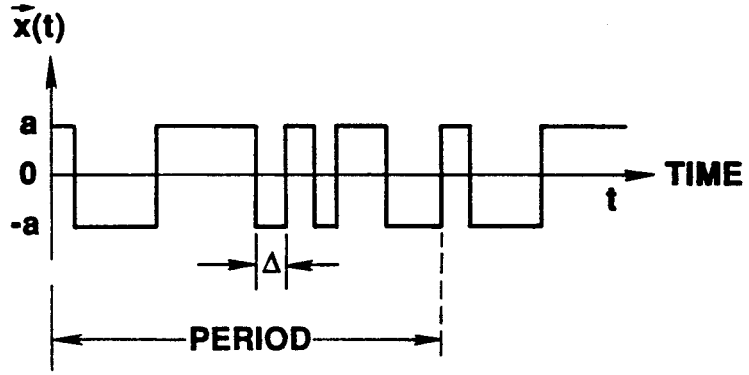
FIG. 28 (A) and 28 (B) are waveform charts of the M-series sequence signal and its auto-correlation function.
Figure 28B:
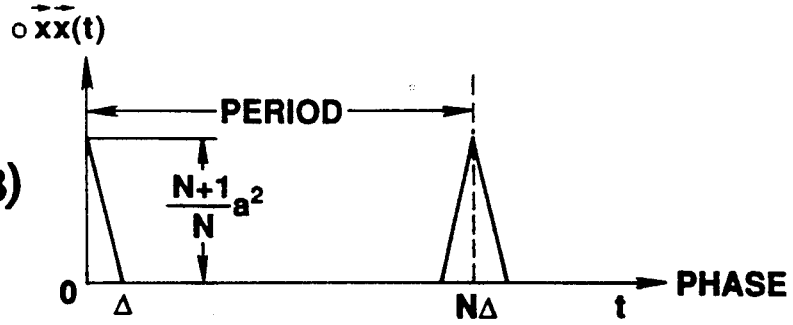

The M-series sequence signal $\bar{x}(t)$ used in the fifth preferred embodiment and it auto-correlation function are shown in FIGS. 28 (A) and 28 (B).

Since the M-series sequence signal used in this embodiment has a minor level and period as compared with the EGR rate controlled value signal, engine driveability is not deteriorated.

FIG. 26 shows a program routine executed by the control unit 5 to diagnose deterioration in the EGR system.

In steps SSS11 through steps SSS14, an impulse response is derived by means of the correlation method using the M-series sequence signal.

In detail, suppose that an input signal to the EGR control system is x(t) and an output signal based on its input refers to a value y (t), which is temperature at a portion located downstream of the EGR control valve. These are expressed using the following equations (7) and (8).

$$x(t)=x(t)+x(t) \tag{7}$$

$$y(t)=y(t)+y(t) \tag{8}$$

In the equations (7) and (8), $\bar{y}(t)$ denotes an output component corresponding to the M-series sequence signal $\bar{x}(t)$ and $\bar{x}(t)$ and $\bar{y}(t)$ denote direct current components.

If the amplitude a of the M-series sequence signal is sufficiently minor, the EGR characteristic within its amplitude (characteristic of the EGR rate with respect to the EGR control quantity) can be deemed to be linear. Therefore, the relationship between the M-series sequence signal $\bar{x}(t)$ and output component $\bar{y}(t)$ can be expressed by three equations (9) through (10) using the impulse response g ($\tau$).

$$y(t) = \int_0^{N\Delta} g(\tau)\{x(t) + x(t-\tau)\}d\tau \tag{9}$$

$$y(t) = \int_0^{N\Delta} g(\tau)x(t)d\tau \tag{10}$$

$$y(t) = \int_0^{N\Delta} g(\tau)x(t-\tau)d\tau \tag{11}$$

The cross-correlation function $\phi\bar{x}\bar{y}(\alpha)$ between the functions of $\bar{x}(t)$ and $\bar{y}(t)$ can be expressed using the following equation (12).

$$\phi xy(\alpha) = \int_0^{N\Delta} g(\tau)\phi xx(\alpha-\tau)d\tau \tag{12}$$

It is noted that a symbol $\phi\bar{x}\bar{x}(\alpha)$ denotes an auto-correlation function of the M-series sequence signal and is expressed as follows:

$$\phi xx(\alpha) = \int_0^{N\Delta} x(\tau)x(\alpha-\tau)d\tau \tag{13}$$

On the other hand, since the M-series sequence signal $\bar{x}(t)$ includes every frequency components, its power spectrum density function $\Phi\bar{x}\bar{x}(\omega)$ is constant. Therefore, $\Phi\bar{x}\bar{x}(\omega)=\Phi\bar{x}\bar{x}(0)$.

Consequently, the auto-correlation function $\phi\bar{x}\bar{x}(\alpha-\tau)$ in the equation (12) is expressed in the following equation using a delta function $\delta$:

$$\phi xx(\alpha-\tau)=\Phi xx(0)\times\delta(\alpha-\tau) \tag{14}$$

Hence, the cross-correlation function $\Phi\bar{x}\bar{y}(\alpha)$ expressed in the equation (12) can be modified as follows:

$$\begin{aligned}\phi xy(\alpha) &= \int_0^{N\Delta} g(\tau)\times\Phi xx(0)\times\delta(\alpha-\tau)d\tau \\ &= \Phi xx(0)\int_0^{N\Delta} g(\tau)\times\delta(\alpha-\tau)d\tau \\ &= \Phi xx(0)\lim_{\epsilon\to 0}\int_{\alpha-\epsilon}^{\alpha+\epsilon} g(\tau)\times\delta(\alpha-\tau)d\tau \\ &= \Phi xx(0)\times g(\alpha)\end{aligned} \tag{14}$$

As appreciated from the above-described equation (14), the impulse response $g(\alpha)$ is expressed in the following equation (15) using the cross-correlation function $\phi\bar{x}\bar{y}(\alpha)$ between $\bar{x}(t)$ and $\bar{y}(t)$:

$$g(\alpha)=\phi xy(\alpha)/\Phi xx(0) \tag{15}$$

$\Phi\bar{x}\bar{x}(0)$ corresponds to an integrated value of the auto-correlation function $\Phi\bar{x}\bar{x}$ and given by the following equation (16).

$$\phi yy(0) = (N+1)\Delta \cdot a^2/N = Z \text{ (constant)} \tag{16}$$

The cross-correlation function $\Phi\bar{x}\bar{y}(\alpha)$ is expressed using the following equation (17).

$$\begin{aligned} \phi xy(\alpha) &= \int_0^{N\Delta} y(t) \cdot x(\alpha - \tau)dt \\ &= \int_0^{N\Delta} \{y(t) - y(t)\} \times x(\alpha - t)dt \\ &= \int_0^{N\Delta} y(t) \times x(\alpha - t)dt - \int_0^{N\Delta} y(t) \cdot x(\alpha - t)dt \\ &= \phi xy(\alpha) - \phi xy(\alpha) \end{aligned} \tag{17}$$

$$\text{Hence, } g(\alpha) = \{\phi xy(\alpha) - \phi xy(\alpha)\}/Z \tag{18}$$

A second term of the equation (18) $\phi\bar{x}\bar{y}(\alpha)$ is the cross-correlation function between the M-series sequence signal $\bar{x}(t)$ and the direct current component of the output $\bar{y}(t)$. $\phi\bar{x}y(\alpha)$ of a first term is the cross-correlation function between the M-series sequence signal $\bar{x}(t)$ and output y(t). The function of y(t) includes a variation component affected by the M-series sequence signal $\bar{x}(t)$ and direct current component. However, it is difficult to separate its components and detect them. Therefore, what is directly derived is the cross-correlation function $\phi\bar{x}y$ as expressed in the following equation (19).

$$\phi xy(\alpha) = \int_0^{N\Delta} y(t) \cdot x(\alpha - t)dt \tag{20}$$

If the value of $\phi\bar{x}y(\alpha)$ is sufficiently taken to a degree such as to provide the value of $\alpha$ so as to have no influence on $\bar{x}(t)$, the value thereof coincides with the value of $\phi\bar{x}y(\alpha)$.

Hence, the value of $\phi\bar{x}\bar{y}(\alpha)$ can be approximated by an average value $g(\alpha)$ during an interval of $a_1$, $\alpha_2$ of $\phi\bar{x}y(\alpha)$ $$g(\alpha) \approx \left\{ \phi xy(\alpha) - \int_{\alpha_1}^{\alpha_2} \phi xy(\alpha)d\alpha/(\alpha_2 - \alpha_1) \right\}/Z \tag{21}$$

The values of $\alpha_1$ and $\alpha_2$ indicating the integration range use those values of $\alpha$ at times when the impulse response $g(\alpha)$ is sufficiently down. $\alpha_2 - \alpha_1$ is selected from a value nearer to $N\Delta$.

The procedure driving the impulse response has been described above.

The step response is easily understandable compared to impulse response.

In this case, step response is the integration value of the impulse response.

If the impulse response $g(\alpha)$ derived from the equation (14) is integrated at an interval $\alpha_S - \alpha_L$, the step response $r(\alpha_L)$ at the time of $\alpha_L$ can be expressed using the following equation:

$$r(\alpha_L) = \int_{\alpha_S}^{\alpha_L} g(\alpha)d\alpha \tag{22}$$

In the equation (22), $\alpha_S$ denotes an integration start time (near to zero) with a time lag on rising edge of the impulse response due to a pseudo whiteness of the M-series sequence signal.

$\alpha_L$ denotes an end time of the integration duration when the impulse response is integrated. The value of $\alpha_L$ is previously set in accordance with the characteristic of the impulse response.

It is noted that since the value of $r(\alpha_L)$ is normalized by Z shown in the equation (21), the value of $r(\alpha_L)$ corresponds to the step response when a unit input is given.

As described above, the theory of step and impulse response of the EGR system will be described above.

In an actual practice, digital signal processing (DSP) is carried out within the control unit 5. Therefore, the integrated value required when the cross-correlation function $\phi\bar{x}y(\alpha)$ is derived and each response $g(\alpha)$ and $r(\alpha)_L$ is derived can be converted into an accumulated value. In other words, an actual control system can be constituted by a discrete value system.

The program routines shown in FIGS. 25 and 26 are carried out at a regular interval or in response to an interrupt request.

In steps SSS11, the control unit 5 receives and stores data on the M-series sequence signal $\bar{x}$ and a temperature y located downstream of the EGR control valve 14.

Figure 29A:
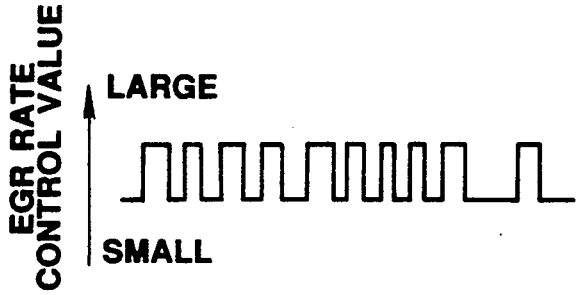
FIG. 29 (A) and 29 (B) are waveform charts of the EGR rate control value in relation to temperature of a portion located downstream of an EGR control valve.
Figure 29B:
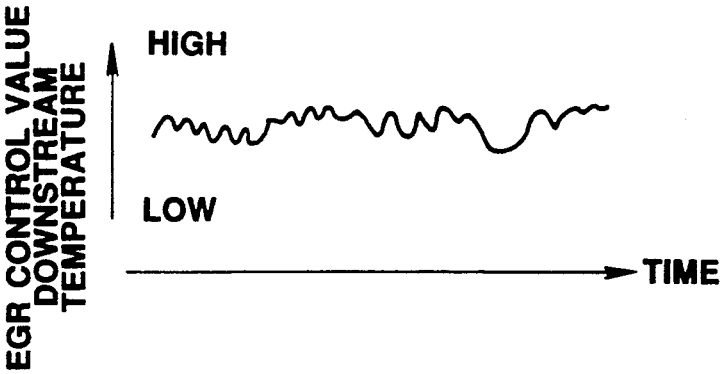

FIGS. 29 (A) and 29 (B) show a change in the EGR rate controlled value on which the M-series sequence signal is superposed and a minute change of a temperature of the portion located downstream of the EGR control valve.

It is noted that the output indicating deterioration in a case when the M-series sequence signal is superposed is not limited to the temperature of the portion located downstream of the EGR control valve. A combustion temperature may alternatively be used. The combustion temperature can be estimated from the intake air passage pressure or in-cylinder pressure. In summary, the output may be related to deterioration of the EGR system.

In a step SSS12, the control unit 5 determines whether the data input of the M-series sequence signal $\bar{x}$ and downstream temperature of the EGR control valve y are ended for each period. The routine goes to the step SSS13.

In the step SSS13, the control unit 5 serves as the cross-correlation function calculating block 3000 in FIG. 23.

The cross-correlation function $\Phi\bar{x}y(\alpha)$ between $\bar{x}$ and y for each predetermined period of time is calculated using the equation (18).

In a step SSS14, the control unit 5 serves as the impulse response calculating block 31. From the equation (18), the impulse response $g(\alpha)$ will be derived via the equation (19).

In a step SSS15, the control unit 5 serves as the step response calculating block 3200 in FIG. 23.

In the step SSS15, the control unit 5 uses the step response $r(\alpha_L)$ to derive the step response $g(\alpha)$ from the equation (20). In this case, $r(\alpha_L)$ represents a value at a time $\alpha_L$ in a case where the EGR rate controlled value is stepwise changed by 1.

In a step SSS16, the control unit 5 serves as the deterioration determining block 3300 of FIG. 23. In the step SSS16, the control unit 5 compares the step response $r(\alpha_L)$ with the reference value rs and determines that deterioration occurs if $r(\alpha_L) \leqq rs$. Then, the routine goes to a step SSS17.

In the step SSS17, the control unit 5 serves as the determination result output block 3400. In the step SSS17, the control unit 5 outputs the result of determination on deterioration.

In response to the output derived from the step SSS17, a warning lamp, for example, installed on the instrument panel of the vehicle is turned on.

FIG. 27 (A) shows a program routine executed by the control unit 5 to calculate the EGR rate controlled value.

In a step SSS21, the control unit 5 reads the intake air quantity Qa, the engine revolutional speed Ne, the battery voltage $V_B$, and coolant temperature Tw.

In a step SSS22, the control unit 5 serves as the basic EGR rate controlled value calculating block 2300. The control unit 5 derives the basic EGR rate controlled value $D_{SET}$[%] by referring to a map shown in FIG. 30 from the engine revolutional speed Ne and the basic pulsewidth Tp (=KXQa/Ne, wherein K denotes the constant) as the engine load.

Figure 30:
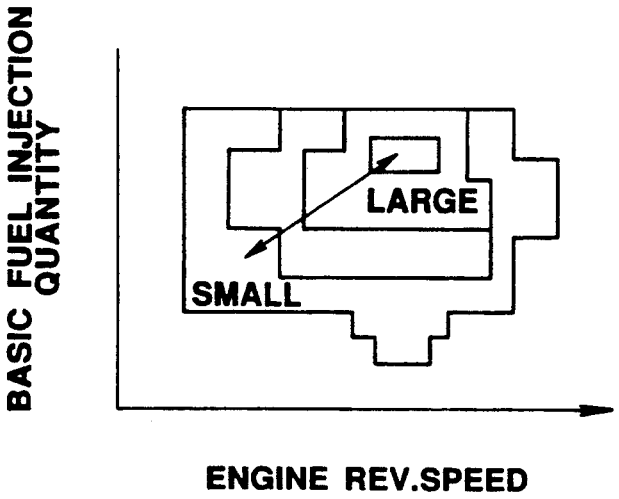
FIG. 30 is a characteristic graph of a basic fuel injection quantity.

It is noted that FIG. 30 shows the map in which values appropriate to the driving condition, selected by experiment or calculation, is stored.

In a step SSS23, the control unit 5 derives the EGR cutoff coefficient $K_{CUT}$.

As shown in FIG. 27 (B), the EGR cutoff coefficient is 0 when the engine falls in the EGR cutoff condition (for example, engine start or engine idling) and 1 when the engine falls in one of the other operating conditions.

Figure 31:
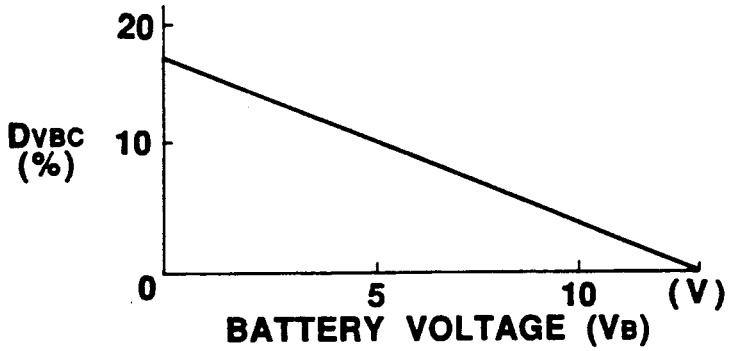
FIG. 31 is a characteristic graph of a duty ratio $D_{VBC}$.

In a step SSS24, the control unit 5 derives a voltage correction coefficient $D_{VAC}$[%] by referring to a map shown in FIG. 31 from the battery voltage $V_B$.

Figure 32:
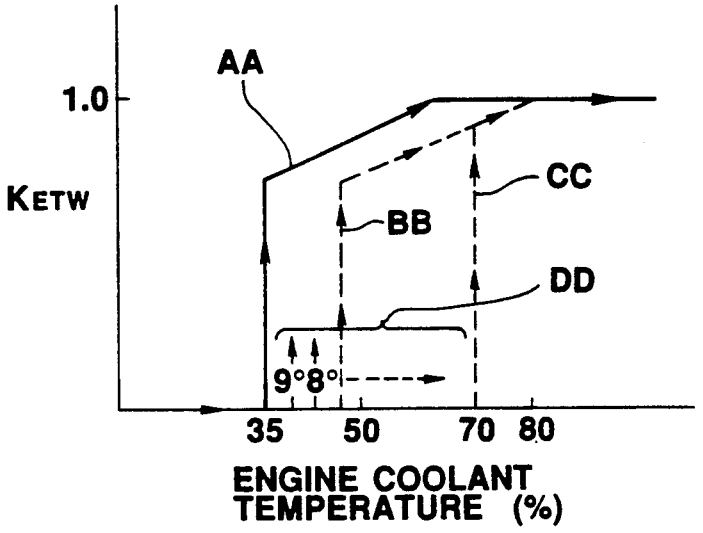
FIG. 32 is a characteristic graph of a correction coefficient of $K_{ETW}$.

In a step SSS25, the control unit 5 derives a coolant temperature correction coefficient $K_{ETW}$ by referring to a map shown in FIG. 32, from the coolant temperature Tw.

The coefficient $K_{ETW}$ is used to reduce the EGR rate during a cold coolant temperature so as to provide an improved driveability during engine warm-up.

In a step SSS26, the control unit 5 derives the EGR rate controlled value $D_{EGR}B$ from the following equation (23).

$$D_{EGR}B=(D_{SET}\times K_{CUT}+D_{VBC})\times K_{ETW} \quad (23)$$

Figure 34:
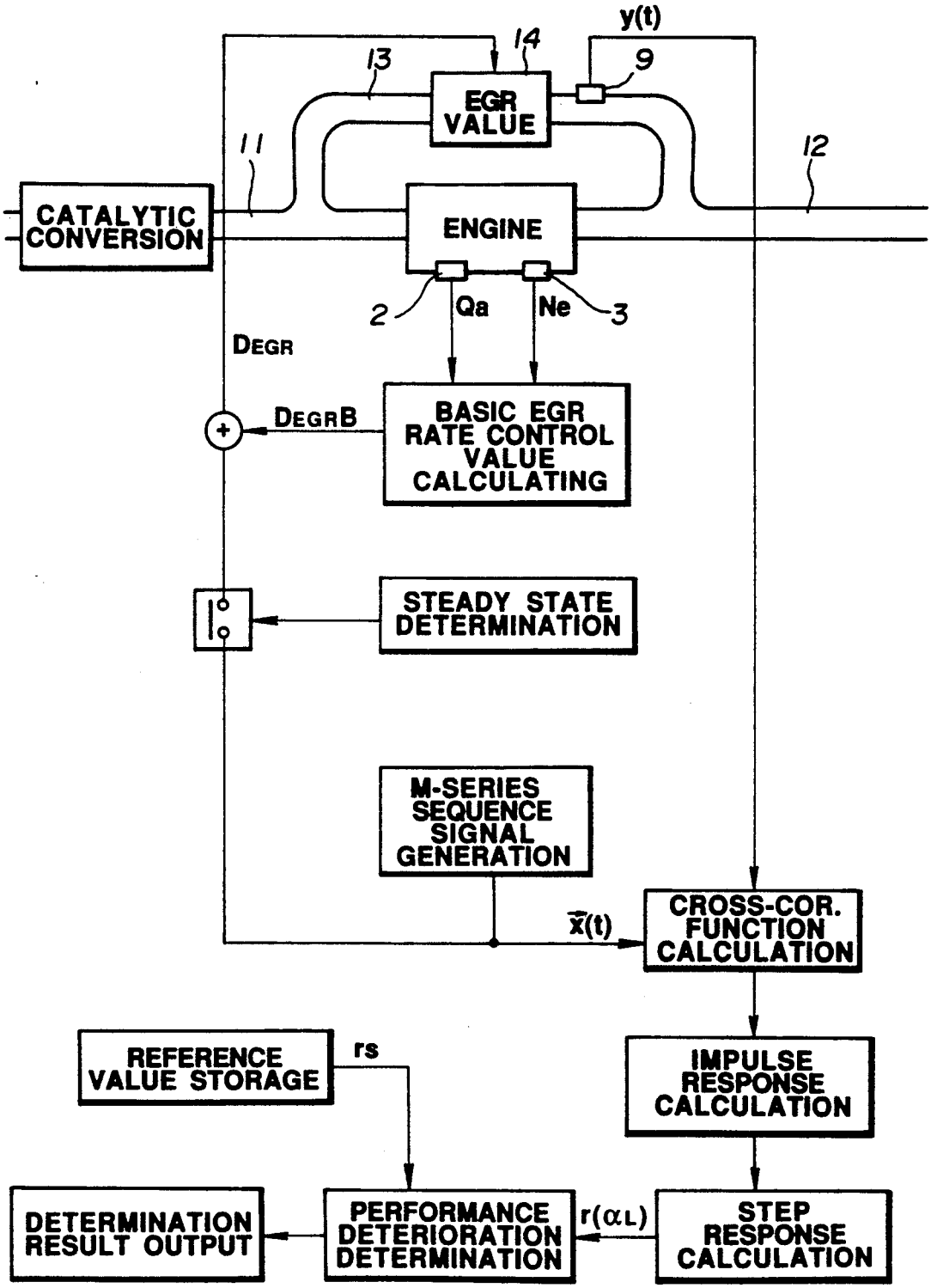
FIG. 34 is a schematic circuit block diagram of the EGR system having the diagnostic function in a sixth preferred embodiment.

FIG. 34 shows a simplified circuit block diagram of the diagnostic system in a sixth preferred embodiment in which the program routines shown in FIGS. 25 through 27 (B) are converted into the circuit structure.

Operation of the fifth and sixth preferred embodiments will be explained below.

FIG. 33 shows the step response of the EGR system. The correlation method in which the M-series sequence signal is superposed is used to accurately derive the step response $r(\alpha_L)$ at the time $\alpha_L$.

Since the EGR system of the engine is the time-lag first order, the response becomes dull as deterioration is advanced so that the performance as the EGR system cannot be maintained at a certain point of boundary.

In the fifth preferred embodiment, the certain point of the boundary is defined as the reference value $r_s$.

If $r(\alpha_L)$ is below the reference value $r_s$, the warning lamp is turned on. Therefore, the driver may recognize that deterioration in the EGR system has occurred.

It is possible to return the EGR system to a normal state before the EGR system fails by effecting repair.

Since in a previously proposed fuel injection system, no monitoring function is installed, the driver would continue to drive without noticing the extent of deterioration of the EGR system.

It is noted that it is not so important to determine which of the parts constituting the EGR system has deteriorated. It is sufficient to check each part of the EGR system at a repair facility when deterioration is diagnosed. That is to say, the diagnostic system according to the present invention checks the EGR system as a whole, to determine whether the present EGR system is possible to use from the point of view of driving safety. Since driving cannot be carried out unless EGR system performance can be wholly maintained. The diagnostic system according to the present invention does not determine which of the parts constituting the EGR system has deteriorated for the maintenance.

Although the M-series sequence signal is superposed during the engine driving, the level and period are minute and the superposition is carried out during the steady state condition. Therefore, engine driveability is not disturbed.

As described hereinabove, since in the self diagnostic system and method according to the present invention applicable to engine controlling systems such as an ignition system, fuel injection system, and/or an EGR system, in which the correlation method is used on the basis of the superposed M-series sequence signal, and the output related to deterioration is output to the diagnostic system to diagnose deterioration of the engine controlling system, deterioration of the engine controlling system can reliably be diagnosed without disturbance of the engine driving and safe driving can be assured.

It will fully be appreciated by those skilled in the art that the foregoing description has been made in terms of the preferred embodiments and various changes and modifications may be made without departing from the scope of the present invention which is to be defined by the appended claims.

What is claimed is:

1. A system for self diagnosing an engine controlling system, comprising:

a) first means for detecting an engine operating condition b) second means for calculating a controlled value on the basis of the engine driving condition c) third means for outputting a signal representing the controlled value d) fourth means for generating a periodic pseudo random signal e) fifth means for superimposing the periodic pseudo random signal on the signal representing the controlled value f) sixth means for providing an output related to deterioration of the engine controlling system which is minutely changed due to the superposition of the pseudo random signal g) seventh means for calculating a cross-correlation function on the basis of the output related to deterioration of the engine controlling system and the periodic pseudo random signal h) eighth means for determining whether a value related to the cross-correlation function exceeds a predetermined value and i) ninth means for providing an output signal when the eighth means determines that the value related to the cross-correlation function exceeds the predetermined value.

2. A system as set forth in claim 1, wherein the periodic pseudo random signal is an M-series sequence signal.

3. A system as set forth in claim 2, wherein the engine controlling system is an ignition system and wherein the second means includes: tenth means for calculating a basic ignition timing angle on the basis of the detected values of the engine operating condition and eleventh means for calculating a dwell angle which is defined as a crank angular range in which no ignition of an air-fuel mixture is carried out on the basis of the engine operating condition.

4. A system as set forth in claim 3, wherein the third means outputs an ignition signal according to the dwell angle and ignition timing calculated by the second means, the ignition system carrying out the ignition of the air-fuel mixture in response to the ignition signal.

5. A system as set forth in claim 4, wherein the sixth means provides the output signal related to deterioration of the ignition system which minutely changes the superposition of the pseudo random signal.

6. A system as set forth in claim 5, wherein the seventh means calculates the cross-correlation function on the basis of an output signal representing a number of occurrences of misfiring.

7. A system as set forth in claim 6, wherein the predetermined value indicates a limit value over which a performance of the ignition system cannot be maintained.

8. A system as set forth in claim 7, wherein the seventh means calculates the number of occurrences of misfiring, the occurrence of misfiring being determined thereby according to change in engine revolutional speed.

9. A system as set forth in claim 8, wherein the seventh means calculates the cross-correlation function using the following function:

$$\phi xy(\alpha) = \int_0^{N\Delta} y(t) \cdot x(\alpha - t)dt,$$

wherein $N\Delta$ denotes one period of the M-series sequence signal $\bar{x}(\alpha - t)$, y(t) denotes a function of the number of occurrences of misfiring per period.

10. A system as set forth in claim 9, wherein the ninth means outputs the signal when $\phi\bar{x}y(\alpha) \geqq R_s$.

11. A system as set forth in claim 10, wherein the predetermined value is varied according to the engine operating condition.

12. A system as set forth in claim 11, wherein the predetermined value becomes lower as an engine load becomes lower.

13. A system as set forth in claim 12, wherein the first means detects the engine load and an engine revolutional speed.

14. A system as set forth in claim 2, wherein a level of the M-series sequence signal is so minor as not to affect an operation of the engine controlling system.

15. A system as set forth in claim 14, which further includes a warning lamp installed on an instrument of a vehicle which turns on in response to the output signal provided by the ninth means.

16. A system as set forth in claim 2, wherein the engine controlling system is a fuel injection system and wherein the second means calculates a basic injection quantity on the basis of the detected engine operating condition.

17. A system as set forth in claim 16, wherein the third means outputs a signal representing a fuel injection quantity determined on the basis of the basic fuel injection quantity to a fuel injection device of the fuel injection system.

18. A system as set forth in claim 17, wherein the sixth means provides the output signal related to deterioration of the fuel injection system and which minutely changes the superposition of the pseudo random signal.

19. A system as set forth in claim 18, wherein the cross-correlation function is calculated on the basis of the output signal related to the number of occurrences of misfiring per predetermined period of time.

20. A system as set forth in claim 19, wherein the predetermined value indicates a limit value over which a performance as the fuel injection system cannot be maintained.

21. A system as set forth in claim 2, wherein the engine controlling system is an EGR system and wherein the second means includes: tenth means for calculating a basic EGR rate controlled value on the basis of the detected values of the engine operating condition and eleventh means for outputting the basic EGR rate, and wherein the third means outputs the controlled value of the EGR rate to an actuator of the EGR system, the actuator opening an EGR control valve according to the output controlled value.

22. A system as set forth in claim 21, wherein the fifth means superposes the M-series sequence signal on the signal representing the basic EGR rate controlled value.

23. A system as set forth in claim 22, wherein the seventh means includes: twelfth means for calculating the cross-correlation function from both the periodic pseudo random signal and output related to deterioration of the EGR system thirteenth means for calculating an impulse response from the cross-correlation function and fourteenth means for integrating the impulse response to derive a step response, and wherein the eighth means determines whether deterioration of the EGR system has occurred according to a result of the step response.

24. A system as set forth in claim 23, wherein the sixth means provides the output signal representing a temperature of a passage of the EGR system located downstream of an EGR control valve of the EGR system.

25. A system as set forth in claim 24, wherein the seventh means calculates the step response as follows:

$$x(t) = x(t) + x(t) \quad (1)$$

$$y(t) = y(t) + y(t) \quad (2),$$

wherein, x(t) denotes an input signal supplied to the EGR control valve of the EGR system, y (t) denotes the temperature of the passage of the EGR system located downstream of the EGR control valve, $\bar{x}(t)$ denotes a function of the M-series sequence signal, $\bar{y}(t)$ denotes an output component corresponding to the M-series sequence signal, and $\bar{x}(t)$ and $\bar{y}(t)$ denote direct current components, and wherein $$y(t) = \int_0^{N\Delta} g(\tau)\{x(t) + x(t-\tau)\}d\tau \quad (3)$$

$$y(t) = \int_0^{N\Delta} g(\tau)x(t)d\tau \quad (4)$$

$$y(t) = \int_0^{N\Delta} g(\tau)x(t-\tau)d\tau, \quad (5)$$

wherein $g(\tau)$ denotes the impulse response, $N\Delta$ denotes one period of the M-series sequence signal, and the cross-correlation function $\phi\vec{x}\vec{y}(\alpha)$ between $\vec{x}(t)$ and $\vec{y}(t)$ is expressed in the following equation:

$$\phi xy(\alpha) = \int_0^{N\Delta} g(\tau)\phi xx(\alpha-\tau)d\tau, \quad (6)$$

wherein $\phi\vec{x}\vec{x}$ denotes an auto-correlation function of the M-series sequence signal $\vec{x}$ and is given as follows;

$$\phi xx(\alpha) = \int_0^{N\Delta} x(\tau)x(\alpha-\tau)d\tau, \quad (7)$$

wherein $\phi\vec{x}\vec{x}(\alpha-\tau)$ is expressed as follows;

$$\phi xx(\alpha-\tau) = \phi xx(0) \times \delta(\alpha-\tau) \quad (8),$$

wherein $\delta(\alpha-\tau)$ denotes a delta function, then the cross-correlation function $\phi\vec{x}\vec{y}(\alpha)$ is modified as follows;

$$\phi xy(\alpha) = \Phi xx(0) \times g(\alpha) \quad (9),$$

wherein $\Phi\vec{x}\vec{x}(0)$ is expressed as follows; ($\Phi\vec{x}\vec{x}(0)$ corresponds to an integrated value of the auto-correlation function $\Phi\vec{x}\vec{x}$ and is expressed as follows)

$$\Phi xx(0) = (N+1)\Delta a^2/N = Z \text{ (constant)} \quad (10)$$

the cross-correlation function $\Phi\vec{x}y(\alpha)$ being expressed as follows;

$$\phi xy(\alpha) = \phi xy(\alpha) - \phi xy(\alpha), \quad (11)$$

hence, $$g(\alpha) = \{\phi xy(\alpha) - \phi xy(\alpha)\}/Z, \quad (12)$$

hence, $$g(\alpha) \approx \left\{ \phi xy(\alpha) - \int_{\alpha_1}^{\alpha_2} \phi xy(\alpha)d\alpha/(\alpha_2 - \alpha_1) \right\}/Z \quad (13)$$

and the step response is derived as follows;

$$r(\alpha_L) = \int_{\alpha_S}^{\alpha_L} g(\alpha)d\alpha \quad (14)$$

26. A system as set forth in claim 25, wherein the eighth means determines whether the calculated step response $r(\alpha_L)$ at a time $\alpha_L$ is compared with the predetermined time $r_s$ and the ninth means provides the output signal when $r(\alpha_L) \leqq r_s$.

27. A system as set forth in claim 26, wherein the third means outputs the EGR rate controlled value with the M-series sequence signal superposed during an engine steady state condition and the EGR rate controlled value is expressed as follows:

$$D_{EGR} = D_{EGR}B + x(t),$$

wherein $D_{EGR}B$ is expressed as follows:

$$D_{EGR}B = (D_{SET} \times K_{CUT} + D_{VBC}) \times K_{ETW},$$

wherein $D_{SET}$ denotes the basic EGR rate controlled value determined according to the engine revolutional speed Ne and an engine load, $K_{CUT}$ denotes an EGR cutoff coefficient, $D_{VBC}$ denotes a vehicular battery correction coefficient, and $K_{ETW}$ denotes a coolant temperature correction coefficient determined according to a coolant temperature of the engine.

28. A system as set forth in claim 27, which further includes thirteenth means for indicating deterioration of the EGR system in response to the output signal derived from the ninth means.

29. A method for self diagnosing an engine control system comprising the steps of:

detecting an operating condition of an engine;

calculating a control value on the basis of the engine operating condition;

generating a signal representing the control value;

generating a periodic pseudo random signal;

superimposing the periodic pseudo random signal on the signal representing the control value to obtain a combined signal;

applying the combined signal as a control signal to an engine control device of the engine control system to control an operating parameter of the engine;

detecting a condition indicative of deterioration of the engine control system;

calculating a cross-correlation function indicating a cross-correlation between the condition indicative of deterioration of the engine control system and the periodic pseudo random signal;

comparing the cross-correlation function with a predetermined value; and generating a signal indicating deterioration of the engine control system when the cross-correlation function exceeds the predetermined value.

30. A method as claimed in claim 29 wherein the control value comprises a dwell angle of an ignition system for the engine.

31. A method as claimed in claim 29 wherein the control value comprises a fuel injection amount for the engine.

32. A method as claimed in claim 29 wherein the control value comprises an exhaust gas recirculation rate.

33. A method as claimed in claim 29 wherein the condition indicative of deterioration is misfiring of the engine.

34. A method as claimed in claim 29 wherein the condition indicative of deterioration is an exhaust gas temperature of the engine.

35. A method as claimed in claim 29 further comprising:

measuring a load of the engine; and varying the predetermined value according to the load.

* * * * *

UNITED STATES PATENT AND TRADEMARK OFFICE

CERTIFICATE OF CORRECTION

PATENT NO. : 5,140,961

DATED : August 25, 1992

INVENTOR(S) : Sawamoto et al.

It is certified that error appears in the above-identified patent and that said Letters Patent is hereby corrected as shown below:

In the following claims the symbols "$\rightarrow$ and $-$" were omitted. The corrected formulas are as follows:

Claim 9, column 21, line 49, -- $\phi_{\vec{x}y}(a) = \int_0^{N\Delta} y(t) \cdot \vec{x}(a - t)dt.$ --.

Claim 25, column 22, line 59, -- $x(t) = \vec{x}(t) + \bar{x}(t)$ --;

Claim 25, column 22, line 61, -- $y(t) = \vec{y}(t) + \bar{y}(t)$ --;

Claim 25, column 23, line 5, -- $y(t) = \int_0^{N\Delta} g(\tau)\{\bar{x}(t) + \vec{x}(t - \tau)\}d\tau$ --;

Claim 25, column 23, line 9, -- $\bar{y}(t) = \int_0^{N\Delta} g(\tau)\bar{x}(t)d\tau$ --;

Claim 25, column 23, line 12, -- $\vec{y}(t) = \int_0^{N\Delta} g(\tau)\vec{x}(t - \tau)d\tau.$ --;

UNITED STATES PATENT AND TRADEMARK OFFICE

CERTIFICATE OF CORRECTION

PATENT NO. : 5,140,961

DATED : August 25, 1992

INVENTOR(S) : Sawamoto et al.

It is certified that error appears in the above-identified patent and that said Letters Patent is hereby corrected as shown below:

Claim 25, col. 23, line 20, -- $\vec{\phi}_{\vec{x}\vec{y}}(a) = \int_0^{N\Delta} g(\tau)\vec{\phi}_{\vec{x}\vec{x}}(a-\tau)d\tau.$ --;

Claim 25, col. 23, line 28, -- $\vec{\phi}_{\vec{x}\vec{x}}(a) = \int_0^{N\Delta} \vec{x}(\tau)\vec{x}(a-\tau)d\tau.$ --;

Claim 25, col. 23, line 33, -- $\vec{\phi}_{\vec{x}\vec{x}}(a-\tau) = \vec{\phi}_{\vec{x}\vec{x}}(0) \times \delta(a-\tau)$ --;

Claim 25, col. 23, line 37, -- $\vec{\phi}_{\vec{x}\vec{y}}(a) = \vec{\Phi}_{\vec{x}\vec{x}}(0) \times g(a)$ --;

Claim 25, col. 23, line 44, -- $\vec{\Phi}_{\vec{x}\vec{x}}(0) = (N+1)\Delta a^2/N = Z$ (constant) --;

Claim 25, col. 23, line 49, -- $\vec{\phi}_{\vec{x}\vec{y}}(a) = \vec{\phi}_{\vec{x}\vec{y}}(a) - \vec{\phi}_{\vec{x}\vec{y}}(a).$ --;

hence,

Claim 25, col. 23, line 51, -- $g(a) = \{\vec{\phi}_{\vec{x}\vec{y}}(a) - \vec{\phi}_{\vec{x}\vec{y}}(a)\}/Z.$ --;

hence.

UNITED STATES PATENT AND TRADEMARK OFFICE

CERTIFICATE OF CORRECTION

PATENT NO. : 5,140,961 Page 3 of 3

DATED : August 25, 1992

INVENTOR(S) : Sawamoto, et al.

It is certified that error appears in the above-indentified patent and that said Letters Patent is hereby corrected as shown below:

Claim 25, col. 23, line 55, --$\vec{x}(a) = \left\{ \vec{\phi x}(a) - \int_{a_1}^{a_2} \vec{\phi x}(a)da/(a_2 - a_1) \right\}/Z$ --;

Claim 27, col. 24, line 6, --$D_{EGR} = D_{EGR} B \vec{x}(t)$. --.

Signed and Sealed this

Twenty-eighth Day of September, 1993

Bruce Lehman

*Attest:*

BRUCE LEHMAN

*Attesting Officer*

*Commissioner of Patents and Trademarks*